US011837042B2

(12) United States Patent
Wakabayashi et al.

(10) Patent No.: US 11,837,042 B2
(45) Date of Patent: Dec. 5, 2023

(54) MEDIUM PROCESSING DEVICE AND AUTOMATIC TRANSACTION DEVICE

(71) Applicant: Oki Electric Industry Co., Ltd., Tokyo (JP)

(72) Inventors: Madoka Wakabayashi, Tokyo (JP); Hayato Shimizu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 695 days.

(21) Appl. No.: 17/044,861

(22) PCT Filed: Apr. 8, 2019

(86) PCT No.: PCT/JP2019/015288
§ 371 (c)(1),
(2) Date: Oct. 1, 2020

(87) PCT Pub. No.: WO2019/225182
PCT Pub. Date: Nov. 28, 2019

(65) Prior Publication Data

US 2021/0158645 A1 May 27, 2021

(30) Foreign Application Priority Data

May 23, 2018 (JP) ..... 2018-098577

(51) Int. Cl.
*G07D 11/18* (2019.01)
*G07D 11/24* (2019.01)
(Continued)

(52) U.S. Cl.
CPC ..... *G07D 11/18* (2019.01); *B65H 43/04* (2013.01); *G07D 11/14* (2019.01); *G07D 11/24* (2019.01);
(Continued)

(58) Field of Classification Search
CPC ..... G07D 11/18; G07D 11/14; G07D 11/24; G07D 2207/00; G07D 11/16; B65H 43/04
See application file for complete search history.

(56) References Cited

U.S. PATENT DOCUMENTS

2014/0190787 A1* 7/2014 Fujita ..... B65H 1/14 194/206

FOREIGN PATENT DOCUMENTS

JP H07112846 A 5/1995
JP 2011081484 A 4/2011
(Continued)

*Primary Examiner* — Jeremy R Severson
(74) *Attorney, Agent, or Firm* — Rabin & Berdo, P.C.

(57) ABSTRACT

A medium processing device includes a first, second and third conveyance path, a classification section, a first, second and third switching unit, a first, second and third storage box and a controller. Each of the first, second and third conveyance paths has two ends. One end of the first conveyance path is connected to one end of the third conveyance path. One end of the second conveyance path is connected to the other end of the third conveyance path at a second side of the classification section opposite to the first side. The other end of the first conveyance path is connected to the other end of the second conveyance path. The controller controls the first conveyance path and the second conveyance path so that the first and second conveyance paths are driven independently from each other.

7 Claims, 7 Drawing Sheets

(51) Int. Cl.

| | |
|---|---|
| ***G07D 11/14*** | (2019.01) |
| ***B65H 43/04*** | (2006.01) |
| *G07D 11/60* | (2019.01) |
| *G07D 7/04* | (2016.01) |
| *G07D 7/164* | (2016.01) |
| *G07D 7/20* | (2016.01) |

(52) U.S. Cl.
CPC ..... *G07D 7/04* (2013.01); *G07D 7/164* (2013.01); *G07D 7/20* (2013.01); *G07D 11/60* (2019.01); *G07D 2207/00* (2013.01); *G07D 2211/00* (2013.01)

(56) References Cited

FOREIGN PATENT DOCUMENTS

| | | | |
|---|---|---|---|
| JP | 2012113366 | A | 6/2012 |
| JP | 2013025438 | A | 2/2013 |
| JP | 2013246597 | A | 12/2013 |
| JP | 2017173862 | A | 9/2017 |

* cited by examiner

MEDIUM PROCESSING DEVICE AND AUTOMATIC TRANSACTION DEVICE

TECHNICAL FIELD

The present disclosure relates to a medium processing device and an automatic transaction device, and is applied to, for example, an automatic teller machine (ATM) that performs a desired transaction by inserting a sheet-shaped medium such as a banknote.

BACKGROUND ART

ATMs widely employed in financial institutions and the like allow a user to deposit cash in the form of banknotes or coins, or allow a user to withdraw cash, according to the content of transactions with the user (financial institution customers, etc.).

One type of ATM is known as a re-cycling type (or recirculating type), in which banknotes deposited by a user in one transaction are reused and withdrawn to another user in a subsequent transaction.

Some re-cycling type ATMs are installed with a banknote deposit/withdrawal device that performs, for example, processing relating a deposit/withdrawal of banknotes (see, for example, Japanese Patent Application Laid-Open (JP-A) No. 2013-25438, (FIG. 2)). Such a banknote deposit/withdrawal devices includes, for example, a customer interface section that gives banknotes to a user and receives banknotes from a user, a conveyance section that conveys banknotes, a classification section that classifies the denomination, authenticity, and other characteristics of the inserted banknotes, and a temporary holding section that temporarily holds the inserted banknotes. The banknote deposit/withdrawal device further includes banknote storage boxes that store banknotes that may be re-used by denomination and a reject box that stores banknotes that should not be re-used.

SUMMARY OF THE INVENTION

Technical Problem

With this configuration, the banknote deposit/withdrawal device may perform a process called an automatic close examination that reexamines a number of banknotes stored in a banknote storage box, the denomination, the physical condition (the presence or absence of damage), and so on at a timing when a transaction is not performed with a customer, for example, after business hours.

When performing the automatic close examination process in the banknote deposit/withdrawal device, for example, one banknote storage box in which banknotes are stored is selected as a movement source, and another banknote storage box in which banknotes are not stored (that is, empty) is selected as a movement destination. Moreover, the banknote deposit/withdrawal device feeds out the banknotes one by one from the movement source, conveys the banknotes along a predetermined conveyance route passing through the classification section by the conveyance section, and sequentially stores the banknotes to the banknote storage box as the movement destination. In this process, the banknote deposit/withdrawal device classifies each banknote in the classification section, and thereby the classification section counts the number of banknotes and identifies the denomination, and the physical condition (the presence or absence of damage), and the like of each banknote.

Here, in a case where the classification section has identified the banknote as being unsuitable for re-use, that is, the classification section is identified as a rejected banknote, it is desirable that the banknote deposit/withdrawal device conveys the rejected banknote to the reject box and stores the rejected banknote in the reject box in a state of being segregated from other banknotes. However, in the banknote deposit/withdrawal device, a route for conveying the rejected banknote to the reject box cannot be formed depending on an arrangement of each banknote storage box, the reject box, the classification section, the conveyance section that conveys the banknote between these components, and the like, and thereby the rejected banknote may not be appropriately processed.

In consideration of the above circumstances, the present disclosure proposes a medium processing device and an automatic transaction device in which both simplification of the configuration and various conveyance of a medium can be achieved at a high level.

Solution to Problem

In order to address the above issue, a medium processing device of the present disclosure includes a first conveyance path, a second conveyance path and a third conveyance path for conveying media, a classification section that is provided on the third conveyance path, and that classifies the media passing thereby, a first switching unit that is provided on the first conveyance path, a second switching unit that is provided on the second conveyance path, a third switching unit that is provided on the third conveyance path at a first side of the classification section, a first storage box that is connected to the first switching unit, and that stores the media conveyed by the first conveyance path, a second storage box that is connected to the second switching unit, and that stores the media conveyed by the second conveyance path, a third storage box that is connected to the third switching unit, and that stores a segregation medium among the media, and a controller that controls the first, second and third conveyance paths, and controls the first, second and third switching units for changing a conveyance route of the media. Each of the first, second and third conveyance paths has two ends. One end of the first conveyance path is connected to one end of the third conveyance path at the first side of the classification section. One end of the second conveyance path is connected to the other end of the third conveyance path at a second side of the classification section opposite to the first side. The other end of the first conveyance path is connected to the other end of the second conveyance path. The controller controls the first conveyance path and the second conveyance path so that the first and second conveyance paths are driven independently from each other.

An automatic transaction device of the present disclosure includes a deposit port that receives media to be transacted, a first conveyance path, a second conveyance path and a third conveyance path for conveying the media, a classification section that is provided on the third conveyance path, and that classifies the media passing thereby, a first switching unit that is provided on the first conveyance path, a second switching unit that is provided on the second conveyance path, a third switching unit that is provided on the third conveyance path at a first side of the classification section, a first storage box that is connected to the first switching unit, and stores the media conveyed by the first conveyance path, a second storage box that is connected to the second switching unit, and stores the media conveyed by the second conveyance path, a third storage box that is connected to the third switching unit, and that stores a segregation medium among the media, and a controller that controls the first, second and third conveyance paths, and controls the first, second and third switching units for changing a conveyance route of the media. Each of the first, second and third conveyance paths has two ends. One end of the first conveyance path is connected to one end of the third conveyance path at the first side of the classification section. One end of the second conveyance path is connected to the other end of the third conveyance path at a second side of the classification section opposite to the first side. The other end of the first conveyance path is connected to the other end of the second conveyance path. The controller controls the first conveyance path and the second conveyance path so that the first and second conveyance paths are driven independently from each other.

According to the present disclosure, the driving force can be supplied to each of a plurality of pair of conveyance rollers and the like for conveying a medium by providing only one drive source in each of the first conveyance path and the second conveyance path. On the other hand, in the present disclosure, since the first conveyance path and the second conveyance path can be driven independently from each other, for example, the other media can be conveyed between the storage boxes connected to the first conveyance path and the first, second and third conveyance paths by driving the first conveyance path while keeping the medium on the second conveyance path.

Advantageous Effects of Invention

According to the present disclosure, it is possible to realize the medium processing device and the automatic transaction device that can achieve both simplification of the configuration and various conveyances of media at a high level.

DESCRIPTION OF EMBODIMENTS

Hereinafter, an embodiment carrying out the invention (hereinafter, referred to as an exemplary embodiment) will be described with reference to the drawings.

1. Overall Configuration of an Automatic Teller Machine

Figure 1:
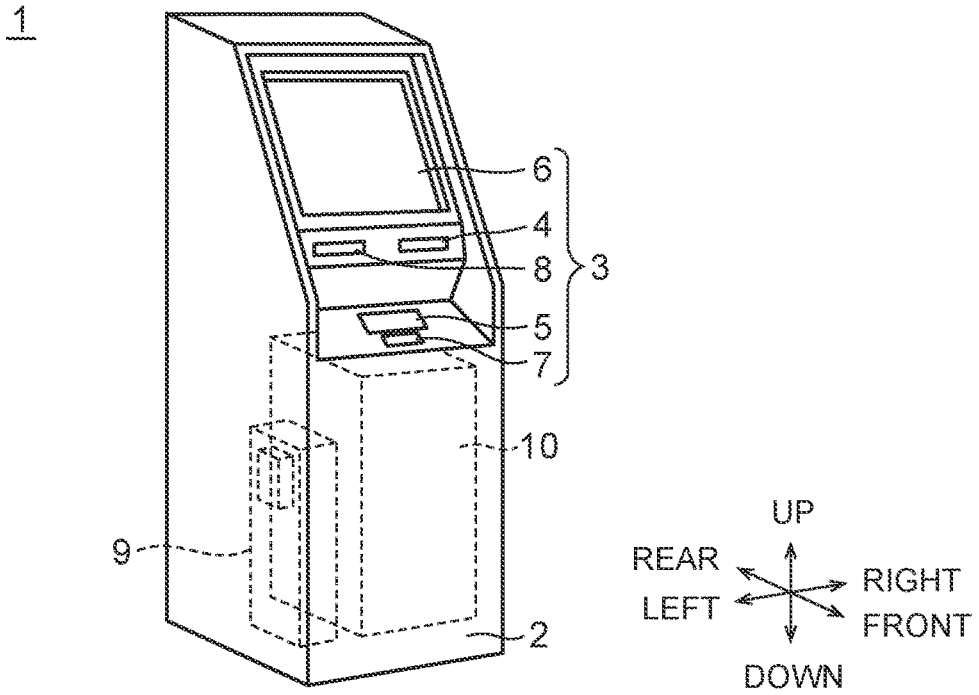
FIG. 1 is a schematic perspective view illustrating an external configuration of an ATM.

As illustrated in the external view of FIG. 1, an ATM 1 as an automatic transaction device is configured mainly by a box-shaped casing 2, and is, for example, installed in a financial institution, various commercial facilities or the like to perform cash transactions such as deposit transactions and withdrawal transactions with a user (that is, a customer of the financial institution or the commercial facilities).

The casing 2 is provided with an interface section 3 at a location enabling easy banknote insertion, touch panel operation, and so on by the customer who is facing the front side of the casing 2. The interface section 3 is provided with a card insertion/removal port 4, a deposit/withdrawal port 5, an operation display section 6, a ten-key 7, and a receipt issue port 8. Cash, cards, and the like are passed between the interface section 3 and the user directly, and the interface section 3 notifies transaction information and receives operation instructions.

The card insertion/removal port 4 is a section for insertion and return of the various cards such as cash cards. A card processing unit (not illustrated in the drawings) that reads account numbers and the like magnetically recorded on the various cards is provided behind the card insertion/removal portion 4. The deposit/withdrawal port 5 is a section that is input with banknotes being deposited by a user, and that dispenses banknotes being paid out to a user. Also, the deposit/withdrawal port 5 is opened or closed by driving a shutter.

The operation display section 6 is integrated with a Liquid Crystal Display (LCD) that displays operation screens during a transaction, and a touch sensor for inputting transaction type selections, and the like. The ten-key 7 is a physical keypad that receives input of, for example, the numbers 0 to 9, and is employed to receive a personal identification number (PIN) code and a transaction amount or other operations requiring a user to input information. The receipt issue port 8 is a section that issues receipts printed with transaction details and the like at the end of transaction processing. A receipt processing unit (not illustrated in the drawings) that prints transaction details and the like on the receipt is provided behind the receipt issue port 8.

In the following explanation, the side of the ATM 1 faced by a user is defined as the front side, and the opposite side thereto is defined as the rear side. The left side and the right side left are respectively defined by the left and right from the perspective of a user facing the front side, and the upper side and lower side are also defined from the perspective of a user facing the front side.

A main controller 9 that performs overall control of the ATM 1, a banknote deposit/withdrawal device 10 that performs various processing related to banknotes, and the like are provided inside the casing 2. The main controller 9 is configured mainly by a Central Processing Unit (CPU), not illustrated in the drawings, and reads and executes predetermined programs from Read Only Memory (ROM) or flash memory, or the like, in order to control the respective sections so as to perform various processing in deposit transactions, withdrawal transactions, and the like. The main controller 9 includes a storage section configured by Random Access Memory (RAM), a hard disk drive, flash memory, or the like inside, and store various information in the storage section.

2. Configuration of Banknote Deposit/Withdrawal Device

Figure 2:
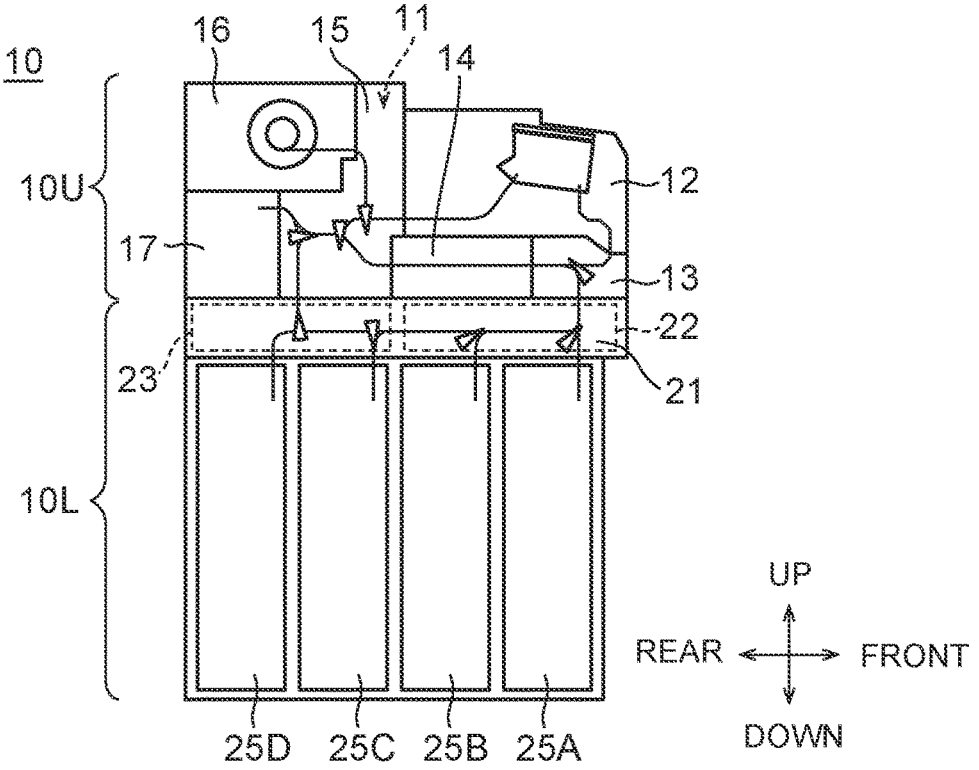
FIG. 2 is a schematic view illustrating a configuration of a banknote deposit/withdrawal device.

As illustrated in a side view of FIG. 2, the banknote deposit/withdrawal device 10 is a medium processing device made up of a plurality of parts performing various processes relating to banknotes. The banknote is formed in a thin rectangular sheet-shape, for example, using a material such as paper or resin.

The banknote deposit/withdrawal device 10 includes an upper unit 10U occupying an upper portion than substantially the center of the banknote deposit/withdrawal device in an up-down direction, and a lower unit 10L occupying a lower portion than substantially the center of the banknote deposit/withdrawal device in the up-down direction. The upper unit 10U and the lower unit 10L are attached to a banknote deposit/withdrawal device frame (not illustrated in the drawings) through slide rails extending in a front-rear direction, and are respectively configured to be able to move in the front-rear direction with respect to the banknote deposit/withdrawal device frame.

2-1. Configuration of the Upper Unit

Figure 3A:
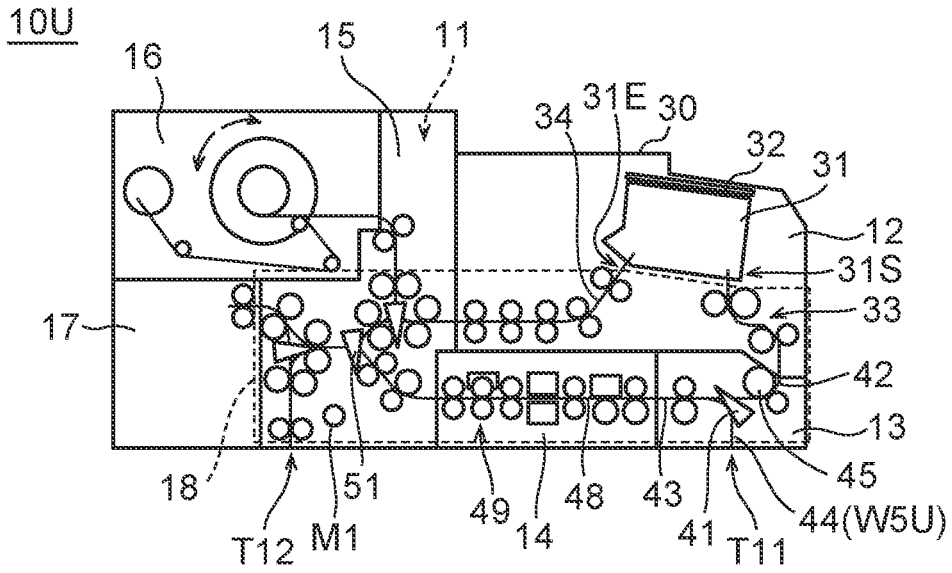
FIG. 3A is a schematic view illustrating a configuration of an upper unit.

As illustrated in FIG. 3A in which a part of FIG. 2 is enlarged, the upper unit 10U is provided with a banknote controller 11 that performs overall control of the banknote deposit/withdrawal device 10, an customer interface section 12, an upper front conveyance section 13, a classification section 14, an upper rear conveyance section 15, a temporary holding section 16 and a reject box 17.

The banknote controller 11 is made up of a CPU, similarly to the main controller 9, and reads and executes predetermined programs from ROM or flash memory, or the like, in order to perform various processes such as a process to determine the conveyance destination of banknotes or a process to control the operation of the each part. The banknote controller 11 includes a storage section made up of RAM, flash memory, or similar storage devices to store information in the storage section.

The customer interface section 12 gives banknotes to a user and receives banknotes from a user, thereby allowing the user to deposit banknotes or to dispense banknote to the user. The customer interface section 12 includes a container 31 that stores banknotes inside a customer interface section frame 30 making up an outer part of the customer interface section 12. An upper part of the container 31 in the customer interface section frame 30 has a hole formed therein penetrating the upper part in the up-down direction, and the hole is opened or closed by a movable shutter 32.

The lower front side of the container 31 is provided with a separating unit 31S that separates banknotes stored in the container 31 one by one and conveys banknotes downward. The lower side of the separating unit 31S forms a conveyance path 33 extending substantially in the up-down direction. The customer interface section 12 conveys banknotes separated by the separating unit 31S downward along the conveyance path 33, and hands over to an upper front conveyance section 13 located on the lower side.

The rear lower side of the container 31 is provided with a discharging unit 31E that discharges banknotes to the container 31. The lower side of the discharging unit 31E forms a conveyance path 34 between the upper rear conveyance section 15 disposed on the rear side and the discharging unit 31E. The conveyance path 34 conveys banknotes conveyed from the upper rear conveyance section 15 frontward, causing the banknotes to be discharged from the discharging unit 31E to the container 31.

The upper front conveyance section 13 is located on the lower front side inside the upper unit 10U. An upper front switching unit 41 is disposed near the center inside the upper front conveyance section 13, and three conveyance paths, such as a conveyance path 42, a conveyance path 43 and a conveyance path 44 are formed around the upper front switching unit 41.

The upper front switching unit 41 is made up of a conveyance guide that guides banknotes, a blade (illustrated by a triangle in the drawings) and a plurality of rollers disposed near the blade. The conveyance guide has a guide face formed in a linear or curved shape when viewed from the left-right direction and regulates the travel range of the banknote by the guide face, to thereby guide the banknotes so as to convey banknotes along the conveyance route. The blade is of a wedge shape ("V"-shape) when viewed from the left-right direction, and guides banknotes by an oblique part of the wedge shape. The blade can be rotated to change the inclination direction. The rollers are disposed so as to face each other across the conveyance path of banknotes and transmit a driving force to banknotes by rotating.

The posture of the blade of the upper front switching unit 41 (that is, an angle of inclination of the portion for guiding the banknote) is changed in accordance with a conveyance destination of each banknote, and each roller rotates in a predetermined rotation direction, based on the control of the banknote controller 11. Hereby, a conveyance route of the banknote can be changed in two ways, and the banknote can be conveyed to the desired conveyance destination. Hereinafter, a switching unit that changes a conveyance route of the banknote in two ways, such as the upper front switching unit 41, is also referred to as a two-way switching unit.

The upper front switching unit 41 can change the current conveyance route to a conveyance route connecting the conveyance path 42 located on the upper front side and the conveyance path 43 located on the rear side, or a conveyance route connecting the conveyance path 44 located on the lower side and the conveyance path 43 located on the rear side, based on the control of the banknote controller 11. The lower end of the conveyance path 44 is provided with an upper unit front hand-off port T11, and thereby banknotes can be handed off between the lower unit 10L and the upper unit front hand-off port T11 (described in detail later).

The classification section 14 is located at the lower side of the customer interface section 12 and the rear side of the upper front conveyance section 13. A linear classification conveyance path 48 extending in the front-rear direction is formed inside the classification section 14 by a plurality of conveyance guides, a pair of conveyance rollers, and the like, and the sensor 49 is disposed along the classification conveyance path 48. The sensor 49 includes, for example, one or more of a magnetic sensor that reads magnetism, an image sensor that reads an image, a thickness sensor that detects the thickness of the banknote, and a traveling sensor that detects a traveling state of the banknote.

The classification section 14 sends out various detection results obtained by the sensor 49 as classification results from the banknote conveyed along the classification conveyance path 48 to the banknote controller 11. In response, the banknote controller 11 identifies the denomination, the authenticity, and the physical condition (the presence or absence of damage) of banknote and recognizes the conveyance state based on the classification results. Hereby, the banknote controller 11 determines a conveyance route of the banknote and a conveyance destination of the banknote based on the obtained results.

The upper rear conveyance section 15 occupies a range of approximately a quarter of the distance in the front-rear direction of the upper unit 10U from an upward/downward center line of the upper unit 10U to the rear side, and the upper rear conveyance section 15 is located behind the customer interface section 12 and the classification section 14. As illustrated in a schematic enlarged view in FIG. 3B, an upper rear switching unit 51 is disposed near the center inside the upper rear conveyance section 15, a temporary holding switching unit 52 is disposed in front of the upper side of the upper rear switching unit 51, a segregation switching unit 53 is disposed behind the upper rear switching unit 51, and further three conveyance paths are connected to each switching unit.

Figure 3B:
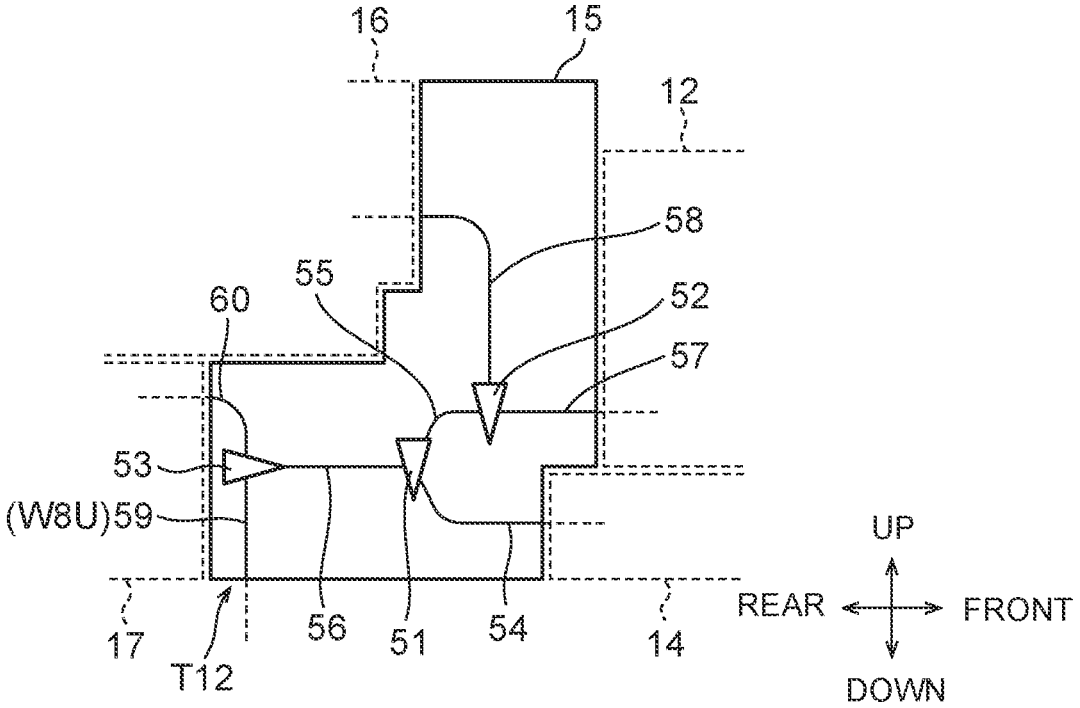
FIG. 3B is a schematic view illustrating a configuration of the upper unit.

In the upper rear conveyance section 15, a conveyance guide that guides banknotes, a roller that transmit a driving force to banknotes and the like are appropriately disposed, similar to the upper front conveyance section 13, and the banknotes are conveyed along the conveyance path described above. In FIG. 3B, for ease of explanation, the roller and the like are omitted, and the conveyance paths are illustrated by the solid lines.

The upper rear switching unit 51 is configured as a two-way switching unit similarly to the upper front switching unit 41, and is connected to a conveyance path 54 located in front of the lower side, a conveyance path 55 located in front of the upper side and a conveyance path 56 located in the rear side. Specifically, the upper rear switching unit 51 can change the current conveyance route to either a conveyance route connecting the conveyance path 54 located in front of the lower side and the conveyance path 55 located in front of the upper side or a conveyance route connecting the conveyance path 54 located in front of the lower side and the conveyance path 56 located the rear side.

The temporary holding switching unit 52 changes its posture by rotating a blade in the same manner as the upper rear switching unit 51, and is what is referred to as a three-way switching unit, which changes a conveyance route of banknotes in three ways, unlike the upper rear switching unit 51. The temporary holding switching unit 52 is connected to the upper rear switching unit 51 by the conveyance path 55, is connected to a conveyance path 34 (FIG. 3A), connected to the customer interface section 12, by a conveyance path 57 located on front side of the temporary holding switching unit 52, and is connected to the temporary holding section 16 by a conveyance path 58 located on the upper side of the temporary holding switching unit 52.

The temporary holding switching unit 52 can change the current conveyance route to, based on the control of the banknote controller 11, a conveyance route connecting the conveyance path 55 with the conveyance path 57, a conveyance route connecting the conveyance path 55 with the conveyance path 58, or a conveyance route connecting the conveyance path 57 with the conveyance path 58. In other words, the temporary holding switching unit 52 can connect any two of the upper rear switching unit 51, the customer interface section 12, or the temporary holding section 16.

The segregation switching unit 53 is configured in the same manner as the temporary holding switching unit 52, and is a three-way switching unit, which changes a conveyance route of banknotes in three ways. The segregation switching unit 53 is connected to the upper rear switching unit 51 by the conveyance path 56, is connected to an upper unit rear hand-off port T12 by a conveyance path 59, and is connected to the reject box 17 by a conveyance path 60.

The segregation switching unit 53 can change the current conveyance route to, based on the control of the banknote controller 11, a conveyance route connecting the conveyance path 56 with the conveyance path 59, a conveyance route connecting the conveyance path 56 with the conveyance path 60, or a conveyance route connecting the conveyance path 59 with the conveyance path 60. The lower end of the conveyance path 59 is provided with the upper unit rear hand-off port T12, and thereby banknotes can be handed off between the lower unit 10L and the upper unit rear hand-off port T12 (described in detail later).

The temporary holding section 16 (FIG. 2) employs a tape escrow method, and includes a drum that is formed in a cylindrical shape and rotates, a tape having one end fixed to a circumferential side face of the drum, a reel that winds the tape from the other end side, and a conveyance roller that conveys banknotes. The temporary holding section 16 conveys the banknotes near the circumferential side face of the drum when receiving the banknotes from the upper conveyance section 15, and rotates the drum, thereby storing the banknotes by wrapping the banknotes against a circumferential side face together with a tape. When the banknotes are fed out, the temporary holding section 16 peels the banknotes together with a tape from the circumferential side face of the drum by rotating the reel and rotating the drum in a direction opposite to a direction in which the banknotes are stored, and sequentially hands off the banknotes to the upper rear conveyance section 15.

The reject box 17 has a storage space for storing banknotes therein, and has a discharging mechanism for discharging banknotes into the storage space. When receiving the banknotes from the upper rear conveyance section 15, the reject box 17 discharges the banknotes into the storage space by the discharging mechanism and stores the banknotes in a stacked state. Banknotes determined to be heavily damaged and unsuitable for re-use (hereinafter, referred to as rejected banknotes) are conveyed to the reject box 17 where they are stored. Specifically, the reject box 17 can segregate rejected banknotes from normal banknotes which can be reused, and the reject box 17 can internally store the rejected banknotes. Hereinafter, the reject box 17 is also referred to as a segregation storage box (i.e., a third storage box), and the rejected banknote is also referred to as a segregation banknote or a segregation medium.

By the way, in the upper unit 10U, a part surrounded by a broken line in FIG. 3A, that is, some or all of rollers, and the like of the customer interface section 12, the upper front conveyance section 13, the classification section 14, the upper rear conveyance section 15 and the reject box 17 are respectively rotated by the driving force supplied from an upper drive motor M1. The upper drive motor M1 rotates in a predetermined forward direction or a reverse direction opposite the forward direction based on the control of the banknote controller 11.

Thus, the upper unit 10U can rotate the upper drive motor M1 by the control of the banknote controller 11 to appropriately rotate each roller, and the like, thereby conveying banknotes along a conveyance route formed at this time. For ease of explanation, a part illustrated by the broken line in FIG. 3A, that is, a part of the customer interface section 12, the upper front conveyance section 13, the classification section 14, the upper rear conveyance section 15 and the reject box 17, is hereinafter also referred to as an upper conveyance section 18.

2-2. Configuration of the Lower Unit

Figure 4:
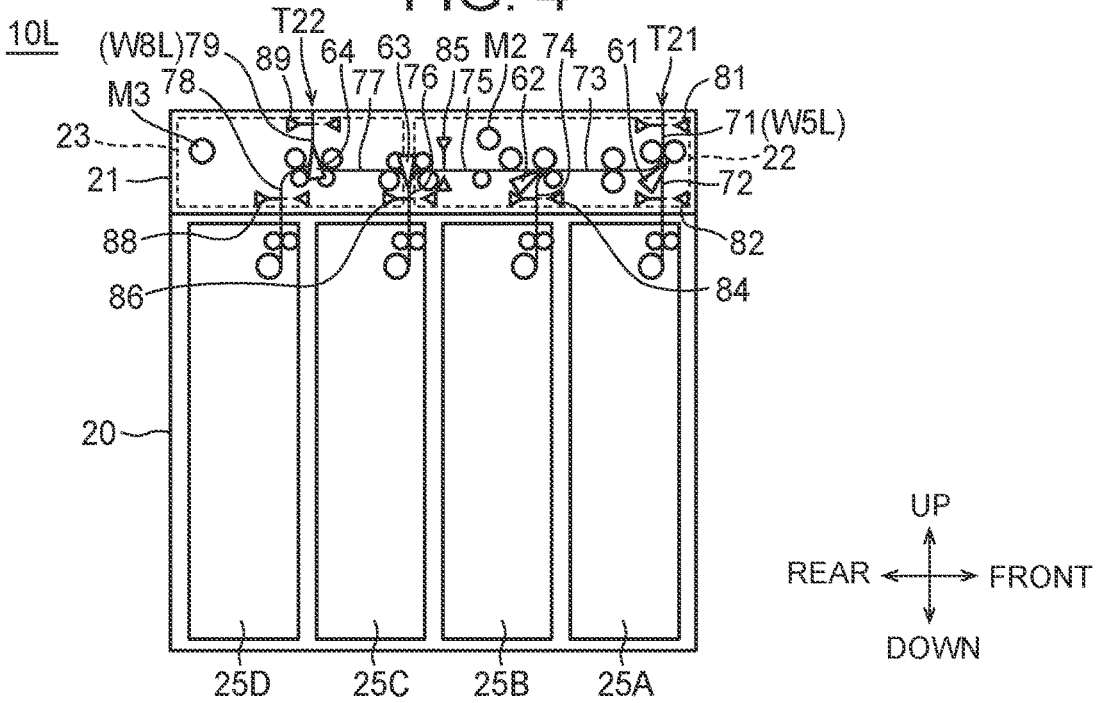
FIG. 4 is a schematic view illustrating a configuration of a lower unit.

As illustrated in FIG. 4 in which a part of FIG. 2 is enlarged, a lower conveyance section 21 that conveys banknotes substantially in the front-rear direction is disposed at an upper end portion of the lower unit 10L. A lower frame 20 is provided below the lower conveyance section 21. The lower frame 20 is formed in a hollow cuboidal shape. The upper side of the lower frame 20 is open, and an internal space of the lower frame 20 is partitioned into four spaces by providing three partitioning plates (not illustrated in the drawings) in the front-rear direction. Hereinafter, each partitioned space is also referred to as a loading space.

In each loading space in the lower frame 20, four banknote storage boxes 25 (25A, 25B, 25C and 25D) that store banknotes, which can be reused (recycled) are disposed in the front-rear direction. The four banknote storage boxes 25 (25A, 25B, 25C and 25D) are disposed in order from the front side to the rear side.

Each of the banknote storage boxes 25 is similarly configured, and is formed in a cuboidal shape that is longer in the up-down direction than in the front-rear direction. Each of the banknote storage boxes 25 is provided with a storage space for accumulating and storing banknotes, a separating and discharging unit disposed above the storage space for separating and discharging banknotes, and a storage box conveyance unit for conveying banknotes between the separating and discharging unit and the upper end of the banknote storage box 25. Each of the banknote storage boxes 25 is designated to store banknotes of a predetermined denomination.

When receiving banknotes from the lower conveyance section 21 in a case of performing a storage process to store banknotes, the banknote storage box 25 conveys banknotes to the separating and discharging unit by the storage box conveyance unit and discharges banknotes into the storage space, thereby storing banknotes in the storage space in an accumulated state. One the other hand, in a case of performing a feeding process to feed out banknotes, the banknote storage box 25 separates banknotes accumulated in the storage space one by one by the separating and discharging unit, and thereby these banknotes are conveyed above by the storage box conveyance unit and are handed off to the lower conveyance section 21.

A switching unit 61 is disposed in the vicinity of the front end inside the lower conveyance section 21 and almost directly above the banknote storage box 25A. In the lower conveyance section 21, a switching unit 62 is disposed behind the switching unit 61 and almost directly above the banknote storage box 25B, and a switching unit 63 is disposed behind the switching unit 62 and almost directly above the banknote storage box 25C. Further, a switching unit 64 is disposed behind the switching unit 63. For ease of explanation, each of the switching unit 61, the switching unit 62, the switching unit 63 and the switching unit 64 is hereinafter also referred to as a storage switching unit.

The switching unit 61 and the switching unit 62 are configured as two-way switching units, similar to the upper front switching unit 41 in the upper unit 10U (FIG. 3A). Similar to the upper front switching unit 41, three conveyance paths together with a plurality of conveyance rollers, conveyance guides, and the like are formed around the switching unit 61 and the switching unit 62, respectively.

A conveyance path 71 extending upward, a conveyance path 72 extending downward and connected to the banknote storage box 25A, and a conveyance path 73 extending rearward and connected to the switching unit 62 are provided around the switching unit 61. The switching unit 61 can change the current conveyance route to a conveyance route connecting the conveyance path 71 located in the upper side and a conveyance path 72 located in the lower side, or a conveyance route connecting a conveyance path 71 located in the upper side and the conveyance path 73 located in the rear side. The upper end of the conveyance path 71 is provided with a lower unit front hand-off port T21, and thereby banknotes can be mutually handed off between the upper unit front hand-off port T11 of the upper unit 10U (FIG. 3A) described above and the lower unit front hand-off port T21.

A conveyance path 74 extending downward and connected to the banknote storage box 25B and a conveyance path 75 extending rearward and connected to the switching unit 63 are provided around the switching unit 62, in addition to the conveyance path 73. The switching unit 62 can change the current conveyance route to a conveyance route connecting the conveyance path 73 located in the front side and the conveyance path 74 located in the lower side, or a conveyance route connecting the conveyance path 73 located in the front side and the conveyance path 75 located in the rear side.

The switching unit 63 and the switching unit 64 are three-way switching units, similar to the temporary holding switching unit 52 of the upper unit 10U (FIG. 3A), and can change a conveyance route of banknotes in three ways (described in detail later) by changing an inclination direction of a blade based on the control of the banknote controller 11. Three conveyance paths, together with a plurality of conveyance rollers and conveyance guides, and the like are respectively formed around each of the switching unit 63 and the switching unit 64.

Around the switching unit 63, a conveyance path 76 extending downward and connected to the banknote storage box 25C as a bidirectional storage box, and a conveyance path 77 extending rearward and connected to the switching unit 64 are provided, in addition to the conveyance path 75. The switching unit 63 can change the current conveyance route to a conveyance route connecting the conveyance path 75 located on the front side of the switching unit 63 and the conveyance path 76 located on the lower side of the switching unit 63, a conveyance route connecting the conveyance path 75 located on the front side of the switching unit 63 and the conveyance path 77 located on the rear side of the switching unit 63, or a conveyance route connecting the conveyance path 77 located on the rear side of the switching unit 63 and the conveyance path 76 located on the lower side of the switching unit 63.

Around the switching unit 64, a conveyance path 78 extending rearward and downward and connected to the banknote storage box 25D, and a conveyance path 79 extending upward are provided, in addition to the conveyance path 77. The switching unit 64 can change the current conveyance route to a conveyance route connecting the conveyance path 77 located on the front side of the switching unit 64 and the conveyance path 78 located on the rear side of the switching unit 64, a conveyance route connecting the conveyance path 77 located on the front side of the switching unit 64 and the conveyance path 79 located on the upper side of the switching unit 64, or a conveyance route connecting the conveyance path 78 located on the rear side of the switching unit 64 and the conveyance path 79 located on the upper side of the switching unit 64. The upper end of the conveyance path 79 is provided with a lower unit rear hand-off port T22, and thereby banknotes can be mutually handed off between the upper unit rear hand-off port T12 of the upper unit 10U (FIG. 3A) described above and the lower unit rear hand-off port T22.

With this configuration, for example, when banknotes are conveyed from the upper unit 10U (FIG. 3A) via the lower unit front hand-off port T21, the lower conveyance section 21 can convey banknotes and store them into the banknote storage boxes 25 (25A, 25B, 25C and 25D), or return banknotes to the upper unit 10U from the lower unit rear hand-off port T22. When receiving banknotes from the banknote storage boxes 25 (25A, 25B, 25C and 25D), the lower conveyance section 21 can convey banknotes to the lower unit front hand-off port T21 and also hand off banknotes to the upper unit 10U.

For example, when banknotes are conveyed from the upper unit 10U via the lower unit rear hand-off port T22, the lower conveyance section 21 can convey banknotes and store them into banknote storage box 25C or the banknote storage box 25D. When receiving banknotes from the banknote storage box 25C or the banknote storage box 25D, the lower conveyance section 21 can convey banknotes to the lower unit rear hand-off port T22 and also hand off to the upper unit 10U.

The lower conveyance section 21 can appropriately sort banknotes conveyed from the upper unit 10U and convey to each of banknote storage boxes 25 (25A, 25B, 25C and 25D), thereby storing banknotes into each of banknote storage boxes 25 (25A, 25B, 25C and 25D). For ease of explanation, a conveyance path formed in the lower conveyance section 21 is hereinafter also referred to as a storage conveyance path.

By the way, each of rollers and the like disposed in about the range of half of the lower conveyance section 21, which is in the front side, that is, each pair of conveyance rollers and the like located directly above the banknote storage box 25A and the banknote storage box 25B, are driven by the driving force from a lower front drive motor M2. Specifically, each pair of conveyance rollers, and the like disposed on the conveyance paths 71, 72, 73, 74 and 75 are driven by the driving force from the lower front drive motor M2. For ease of explanation, the range of half of the lower conveyance section 21, which is in the front side, is hereinafter also referred to as a lower front conveyance section 22, and a conveyance path in the lower front conveyance section 22 is also referred to as a classification side storage conveyance path. Moreover, each of the banknote storage box 25A and the banknote storage box 25B connected to the lower front conveyance section 22 is also referred to as a classification side storage box.

Each of rollers and the like disposed in about the range of half of the lower conveyance section 21, which is in the rear side, that is, each pair of conveyance rollers and the like located directly above the banknote storage box 25C and the banknote storage box 25D, are driven by the driving force from a lower rear drive motor M3. Specifically, each pair of conveyance rollers, and the like disposed on the conveyance paths 76, 77, 78 and 79 are driven by the driving force from the lower front drive motor M3. For ease of explanation, a range of half of the lower conveyance section 21, which is in the rear side, is hereinafter also referred to as a lower rear conveyance section 23, and a conveyance path in the lower rear conveyance section 23 is also referred to as a segregation side storage conveyance path (i.e., a first conveyance path). Moreover, each of the banknote storage box 25C and the banknote storage box 25D connected to the lower rear conveyance section 23 is also referred to as a segregation side storage box.

Thus, in the lower conveyance section 21, the lower front conveyance section 22 and the lower rear conveyance section 23 can be driven independently of each other by individually controlling the lower front drive motor M2 and the lower rear drive motor M3. More specifically, it is possible to stop the lower rear conveyance section 23 while conveying the banknotes by the lower front conveyance section 22.

Each sensor that detects the medium is provided at a location where banknotes are handed off between the upper unit 10U and the lower conveyance section 21, at a location where banknotes are handed off between each banknote storage box 25 and the lower conveyance section 21, and at a location where banknotes are handed off between the lower front conveyance section 22 and the lower rear conveyance section 23. More specifically, in the lower conveyance section 21, a sensor 81 is provided in the vicinity of the upper end of the conveyance path 71, and a sensor 89 is provided in the vicinity of the upper end of the conveyance path 79. In the lower conveyance section 21, a sensor 82 is provided in the vicinity of the lower end of the conveyance path 72, a sensor 84 is provided in the vicinity of the lower end of the conveyance path 74, a sensor 86 is provided in the vicinity of the lower end of the conveyance path 76, and a sensor 88 is provided in the vicinity of the lower end of the conveyance path 78. Further, in the lower conveyance section 21, a sensor 85 is provided in the vicinity of a rear end of the conveyance path 75.

Each of the sensors 81, 82, 84, 85, 86, 88 and 89 is an optical sensor, and is disposed so that a light emitting part and a light receiving part face each other across a conveyance path. The light receiving part receives the detection light emitted from the light emitting part and traversing the conveyance path. Thereby, each of the sensors 81, 82, 84, 85, 86, 88 and 89 generates a detection signal based on the obtained light reception result, and sends out it to the banknote controller 11. The banknote controller 11 can recognize that the banknote has reached at the location where the sensor 81 or the like is installed in each conveyance path, or that the banknote has passed, based on the detection signal obtained from each of the sensors 81, 82, 84, 85, 86, 88 and 89. For ease of explanation, each of the sensors 81, 82, 84, 85, 86, 88 and 89 is also referred to as a medium detecting sensor.

3. Various Processes in the Banknote Deposit/Withdrawal Device

Figure 5:
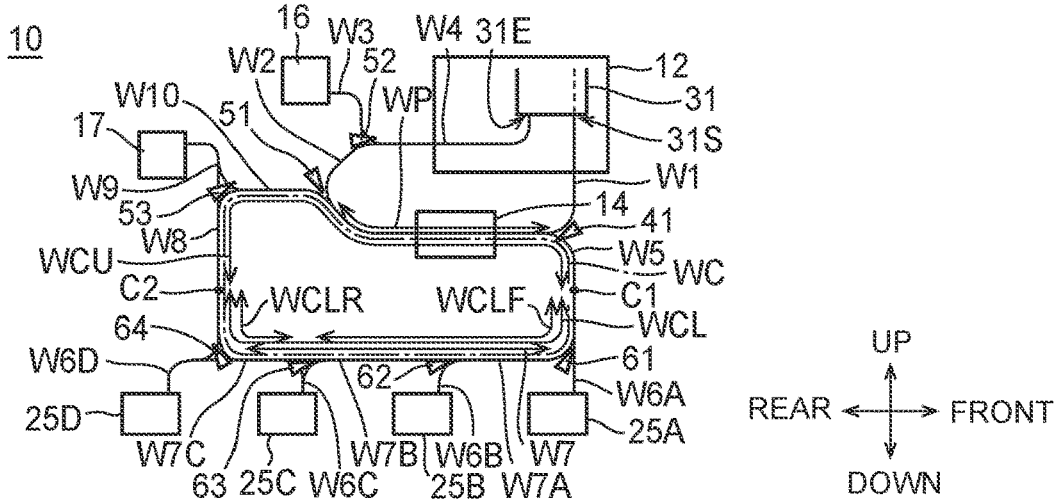
FIG. 5 is a schematic view illustrating a configuration of the banknote deposit/withdrawal device.

A banknote deposit/withdrawal device 10 (FIG. 2, FIG. 3A, FIG. 3B and FIG. 4) is schematically illustrated in FIG. 5. Processes for conveying banknotes in a deposit process and a withdrawal process will be described in detail below.

In the banknote deposit/withdrawal device 10, the upper unit 10U and the lower unit 10L are housed in the banknote deposit/withdrawal device frame (FIG. 2), and thereby the upper unit front hand-off port T11 (FIG. 3A) and the lower unit front hand-off port T21 (FIG. 4) are connected in the vicinity of the front end of the upper unit 10U and the lower unit 10L. Thereby, a front connecting port C1 (FIG. 2 and FIG. 5) for handing off banknotes between the upper unit front hand-off port T11 and the lower unit front hand-off port T21 is formed. Moreover, in the banknote deposit/withdrawal device 10, the upper unit rear hand-off port T12 (FIG. 3A) and the lower unit rear hand-off port T22 (FIG. 4) are connected in the vicinity of rear end in the upper unit 10U and the lower unit 10L, and thereby a rear connecting port C2 (FIG. 2 and FIG. 5) for handing off banknotes between the upper unit rear hand-off port T12 and the lower unit rear hand-off port T22 are formed.

In FIG. 5, the customer interface section 12, the classification section 14, the temporary holding section 16, the reject box 17 and the banknote storage boxes 25 (25A, 25B, 25C and 25D) are respectively represented by simple rectangles. Hereinafter, each of the customer interface section 12, the classification section 14, the temporary holding section 16, the reject box 17 and the banknote storage boxes 25 (25A, 25B, 25C and 25D) may be also simply referred to as a module. Further, in FIG. 5, the upper front switching unit 41 disposed in the upper front conveyance section 13, the upper rear switching unit 51, the temporary holding switching unit 52 and the segregation switching unit 53 disposed in the upper rear conveyance section 15, and the switching unit 61, the switching unit 62, the switching unit 63 and the switching unit 64 disposed in the lower conveyance section 21 are respectively represented by simply triangles. Hereinafter, each of the upper front switching unit 41, the upper rear switching unit 51, the temporary holding switching unit 52, the segregation switching unit 53, the switching unit 61, the switching unit 62, the switching unit 63, and the switching unit 64 may also simply referred to as a switching unit.

In FIG. 5, a conveyance path connecting each of modules and each of switching units is represented by a line segment (that is, a straight line, a curve, or a combination thereof). However, in some parts of FIG. 5, a plurality of conveyance paths connecting each of modules and each of conveyance sections to each other are collectively explained to as one conveyance path.

A basic conveyance path WP corresponds to the conveyance path 43 in the upper front conveyance section 13, the classification conveyance path 48 in the classification section 14 and the conveyance path 54 in the upper rear conveyance section 15. That is, the basic conveyance path WP is a conveyance path extending substantially in the front-rear direction that connects the upper front switching unit 41 and the upper rear switching unit 51 and penetrates the classification section 14.

A conveyance path W1 corresponds to the conveyance path 33 in the customer interface section 12 and the conveyance path 42 in the upper front conveyance section 13. A conveyance path W2 corresponds to the conveyance path 55 in the upper rear conveyance section 15. A conveyance path W3 corresponds to the conveyance path 58 in the upper rear conveyance section 15. A conveyance path W4 corresponds to the conveyance path 57 in the upper rear conveyance section 15 and the conveyance path 34 in the customer interface section 12. A conveyance path W5 corresponds to the conveyance path 44 in the upper front conveyance section 13 and the conveyance path 71 in the lower conveyance section 21. For ease of explanation, the conveyance path 44 in the upper front conveyance section 13, which is in a side of the upper unit 10U, may also be referred to as a conveyance path WSU, and the conveyance path 71 in the lower conveyance section 21, which is in a side of the lower unit 10L, may also be referred to as a conveyance path WSL.

A conveyance path W6A, a conveyance path W6B, a conveyance path W6C and a conveyance path W6D correspond to the conveyance path 72, the conveyance path 74, the conveyance path 76 and the conveyance path 78 in the lower conveyance section 21 respectively. The conveyance path W6A, the conveyance path W6B, the conveyance path W6C and the conveyance path W6D are collectively referred to as a conveyance path W6. A conveyance path W7A, a conveyance path W7B and a conveyance path W7C correspond to the conveyance path 73, the conveyance path 75 and the conveyance path 77 in the lower conveyance section 21 respectively. The conveyance path W7A, the conveyance path W7B and the conveyance path W7C are collectively referred to as a conveyance path W7.

The conveyance path W6A, the conveyance path W6B, the conveyance path W7A and the conveyance path W7B are conveyance paths in the lower front conveyance section 22. Further, the conveyance path W6C, the conveyance path W6D and the conveyance path W7C are conveyance paths in the lower rear conveyance section 23.

A conveyance path W8 corresponds to the conveyance path 79 in the lower conveyance section 21 and the conveyance path 59 in the upper rear conveyance section 15. For ease of explanation, the conveyance path 59 in the upper rear conveyance section 15, which is in the side of the upper unit 10U, may also be referred to as a conveyance path W8U, and the conveyance path 79 in the lower conveyance section 21, which is in the side of the lower unit 10L, may also be referred to as a conveyance path W8L. A conveyance path W9 corresponds to the conveyance path 60 in the upper rear conveyance section 15. A conveyance path W10 corresponds to the conveyance path 56 in the upper rear conveyance section 15.

Herein, when looking again at FIG. 5, in the banknote deposit/withdrawal device 10, a loop-shaped conveyance path is formed in the lower side of the classification section 14, and is formed by the conveyance path W5, the conveyance path W7, the conveyance path W8, the conveyance path W10, and the basic conveyance path WP, clockwise from the upper front switching unit 41. Hereinafter, the loop-shaped conveyance path may be referred to as a loop-shaped conveyance path WC.

In addition to this, a part corresponding to inside the upper unit 10U in the loop-shaped conveyance path WC, that is, the part made up of the conveyance path W8U, the conveyance path W10, the basic conveyance path WP and the conveyance path W5U, may also be referred to as a upper loop-shaped conveyance path WCU or a main conveyance path (i.e., a third conveyance path). Moreover, a part corresponding to inside the lower unit 10L in the loop-shaped conveyance path WC, that is, a part made up of the conveyance path W5L, the conveyance path W7A, the conveyance path W7B, the conveyance path W7C and the conveyance path W8L, may also be referred to as a lower loop-shaped conveyance path WCL or the storage conveyance path.

In addition, a part corresponding to the lower front conveyance section 22 in the lower loop-shaped conveyance path WCL, that is, a part made up of the conveyance path W5L, the conveyance path W7A and the conveyance path W7B, may also be referred to as a lower front loop-shaped conveyance path WCLF or the classification side storage conveyance path (i.e., a second conveyance path). Moreover, a part corresponding to the lower rear conveyance section 23 in the lower loop-shaped conveyance path WCL, that is, a part made up of the conveyance path W7C and the conveyance path W8L, may also be referred to as a lower rear loop-shaped conveyance path WCLR or the segregation side storage conveyance path (i.e., the first conveyance path).

3-1. Deposit Process and Storage Process

First, a case where the ATM 1 (FIG. 1) executes a deposit transaction with a user (that is, a customer of a financial institution) will be described. In this case, the banknote deposit/withdrawal device 10 performs the deposit process in a first stage (also referred to as a deposit count process or a receiving process) in which the number of banknotes is counted while classifying the denomination and the like of deposited banknotes. The deposit/withdrawal device 10 also performs a storage process in a subsequent second stage (also referred to as a deposit storage process) in which each banknote is conveyed to, and stored in, the appropriate storage location.

More specifically, when an operation input for starting the deposit transaction is received from a user via the operation display section 6 (FIG. 1), the banknote controller 11 of the banknote deposit/withdrawal device 10 starts the deposit process by cooperating with the main controller 9 (FIG. 1) of the ATM 1. The banknote deposit/withdrawal device 10 first opens the shutter 32 (FIG. 3A) of the customer interface section 12, and allows the user to insert banknotes into the container 31. Next, when an input is received from the user via the operation display section 6 (FIG. 1) to begin receiving banknotes, the banknote controller 11 closes the shutter 32 of the customer interface section 12, and then the separating unit 31S separates banknotes in the container 31 one-by-one. The banknote controller 11 sequentially hands off banknotes to the conveyance path W1 located on a downstream side of the separating unit 31S.

Figure 6A:
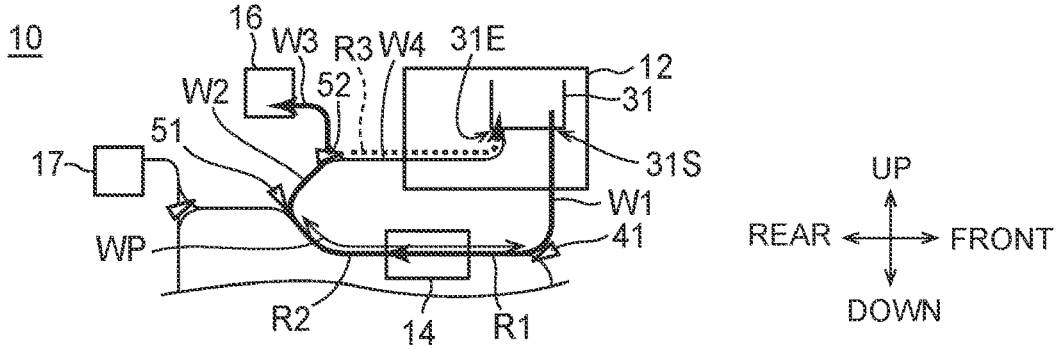
FIG. 6A is a schematic view illustrating a conveyance route of banknotes in a deposit process and a storage process.

As indicated by an arrow direction R1 in FIG. 6A, the banknote deposit/withdrawal device 10 conveys banknotes along the conveyance path W1 and the basic conveyance path WP, and the banknotes are classified by the classification section 14. The banknote deposit/withdrawal device 10 then supplies the obtained classification results to the banknote controller 11. In response, the banknote controller 11 identifies the denomination, the authenticity, and the physical condition (the presence or absence of damage) of banknote based on the obtained classification results. Next, the banknote controller 11 identifies whether each banknote can be identified as a normal banknote to be a deposit-acceptable banknote, which may continue on to subsequent processing. Each banknote that cannot be identified as a normal banknote is identified as a deposit-rejected banknote that should provisionally be given back to the user. The banknote controller 11 counts and stores the number of the deposit-rejected banknotes.

The banknote deposit/withdrawal device 10 conveys banknotes while changing a conveyance route in accordance with a classification result of each banknote based on the control of the banknote controller 11. More specifically, as indicated by an arrow direction R2, the banknote deposit/withdrawal device 10 continues to convey the deposit-acceptable banknotes along the basic conveyance path WP, and then sequentially hands off the banknotes to the temporary holding section 16 by conveying along the conveyance path W2 and the conveyance path W3, and thereby the banknotes are stored in the temporary holding section 16.

On the other hand, the banknote deposit/withdrawal device 10 conveys the deposit-rejected banknotes to the temporary holding switching unit 62 in the same manner as the deposit-acceptable banknotes, and then conveys the deposit-rejected banknotes along the conveyance path W4 as indicated by an arrow direction R3, thereby causing to store the deposit-rejected banknotes into the container 31 of the customer interface section 12, and returning the deposit-rejected banknotes to the user.

The banknote deposit/withdrawal device 10 completes the deposit process when all banknotes have been conveyed to the temporary holding section 16 without being identified as the deposit-rejected banknotes, or when the deposit-rejected banknotes have been returned to the user. At this time, the banknote deposit/withdrawal device 10 calculates, in the banknote controller 11, a deposit amount based on a counting result of denomination and the number of banknotes taken in from the customer interface section 12, and displays a predetermined operation instruction screen on the operation display section 6 (FIG. 1). Thereby, the banknote deposit/withdrawal device 10 presents the user with the deposit amount and prompts the user to select whether or not to continue the deposit transaction.

Herein, when the user provides an instruction to the deposit/withdrawal device 10 to cancel the deposit transaction, the banknote deposit/withdrawal device 10 sequentially conveys all banknotes held in the temporary holding section 16 along the conveyance path W3 and the conveyance path W4, and discharges the banknotes into the container 31 of the customer interface section 12, thereby returning the banknotes to the user by opening the shutter 32 (FIG. 3A).

Figure 6B:
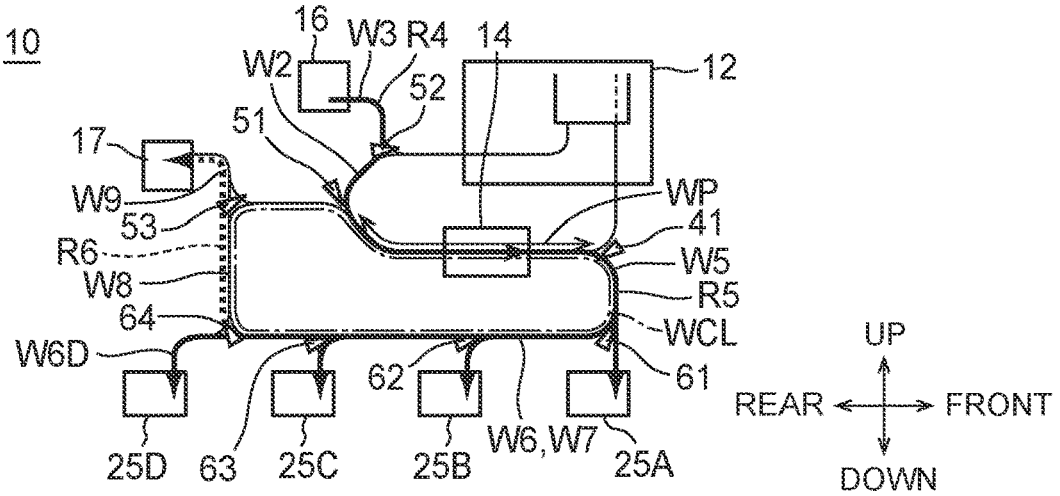
FIG. 6B is a schematic view illustrating a conveyance route of banknotes in the deposit process and the storage process.

On the other hand, as illustrated in FIG. 6B, the banknote deposit/withdrawal device 10 starts the storage process when the user provides an instruction to the deposit/withdrawal device 10 to continue the deposit transaction. More specifically, the banknote controller 11 sequentially feeds out the banknotes stored in the temporary holding section 16 (deposit-acceptable banknotes) and sequentially conveys them to the classification section 14 along the conveyance path W3, the conveyance path W2 and the basic conveyance path WP, as indicated by an arrow direction R4, and thereby the banknotes are sequentially classified. At this time, the banknote controller 11 determines, based on the classification result obtained from the classification section 14, whether the destination of the banknote is the reject box 17, in the case of the rejected banknote or one of the banknote storage boxes 25 (25A, 25B, 25C and 25D), in the case of the normal banknotes which can be reused.

Subsequently, the banknote deposit/withdrawal device 10 continuously conveys the normal banknotes along the basic conveyance path WP as indicated by an arrow direction R5, and further conveys them along a part of the conveyance path W5, the conveyance path W6 and the conveyance path W7. Thereby, the normal banknotes are stored to each of banknote storage boxes 25 (25A, 25B, 25C and 25D), which is as a conveyance destination corresponding to each denomination. The banknote deposit/withdrawal device 10 conveys the rejected banknote to the switching unit 64 along the arrow direction R5, and then conveys and stores the rejected banknote to the reject box 17 along the conveyance path W8 and the conveyance path W9 as indicated by an arrow direction R6.

The banknote deposit/withdrawal device 10 is capable of sorting and storing normal banknotes that may be re-used in each of the banknote storage boxes 25, and the deposit/withdrawal device 10 is also capable of storing rejected banknotes that should not be re-used in the reject box 17. Eventually, the banknote deposit/withdrawal device 10 finishes the storage process when all banknotes stored in the temporary holding section 16 have been conveyed to each conveyance destination.

3-2. Withdrawal Process

Next, a case where the ATM 1 (FIG. 1) executes a withdrawal transaction with a user will be described. In this case, the banknote deposit/withdrawal device 10 performs the withdrawal process to withdraw a denomination and a number of banknotes according to an amount specified by a user.

More specifically, when a user provides an input to start the withdrawal transaction via the operation display section 6, or when a user provides an input of a withdrawal amount via the operation display section 6 (FIG. 1), the banknote controller 11 of the banknote deposit/withdrawal device 10 starts the withdrawal process by cooperating with the main controller 9 (FIG. 1) of the ATM 1. At this time, the banknote controller 11 first determines denomination and a number of banknotes according to the withdrawal amount. Subsequently, the banknote deposit/withdrawal device 10 feeds out the banknotes stored in each of banknote storage boxes 25 while separating them one by one according to the determined denomination and the number of banknotes, and sequentially hands off the banknotes to the downstream conveyance path W6.

Subsequently, the banknote deposit/withdrawal device 10 conveys the banknotes along the conveyance path W6, the conveyance path W7, the conveyance path W5 and the basic conveyance path WP as indicated by an arrow direction R9 in FIG. 7, thereby classifying the banknotes when passing through the classification section 14. Here, on the basis of the traveling state among the classification result obtained from the classification section 14, the banknote controller 11 determines the customer interface section 12 as a conveyance destination of normal banknotes, while the banknote controller 11 determines the reject box 17 as a conveyance destination of rejected banknotes having a problem in a traveling state, such as a state where multiple banknotes are overlapped.

As indicated by an arrow direction R10, the banknote deposit/withdrawal device 10 conveys the normal banknote to the downstream customer interface section 12 along the basic conveyance path WP, the conveyance path W2 and the conveyance path W4, and discharges and stacks the normal banknotes into the container 31. After that, the banknote deposit/withdrawal device 10 opens the shutter 32 of the customer interface section 12 (FIG. 3A), and pays out the banknotes stored in the container 31. Thereby, the user can take the banknotes from the container 31. Further, the banknote controller 11 conveys the rejected banknotes to the upper rear switching unit 51 along the arrow direction R10, and then conveys them to the reject box 17 along the conveyance path W10 and the conveyance path W9, to store them inside the reject box 17, as indicated by the arrow direction R11.

3-3. Rearward Banknote Movement Process

Next, a banknote movement process for moving the banknotes between the banknote storage boxes 25 in the banknote deposit/withdrawal device 10 will be described. Here, a case will be described in which the banknotes are moved substantially rearward with the banknote storage box 25 (25A or 25B) located in the front side as a movement source and the banknote storage box (25C or 25D) located in the rear side as a movement destination. Hereinafter, this process is also referred to as a rearward banknote movement process.

More specifically, when the banknote deposit/withdrawal device 10 receives an instruction such as the banknote storage boxes 25 of the movement source and the movement destination and the number of banknotes to be moved from a financial institution staff via the operation display section 6 (FIG. 1), the banknote movement process is started. In the same manner as in the case of the withdrawal process (FIG. 7), the banknote deposit/withdrawal device 10 feeds out the banknotes stored therein while separating the banknotes one by one from the banknote storage box 25A or 25B designated as the movement source, and then sequentially hands off the banknote to the downstream conveyance path W6A or the conveyance path W6B.

Figure 8:
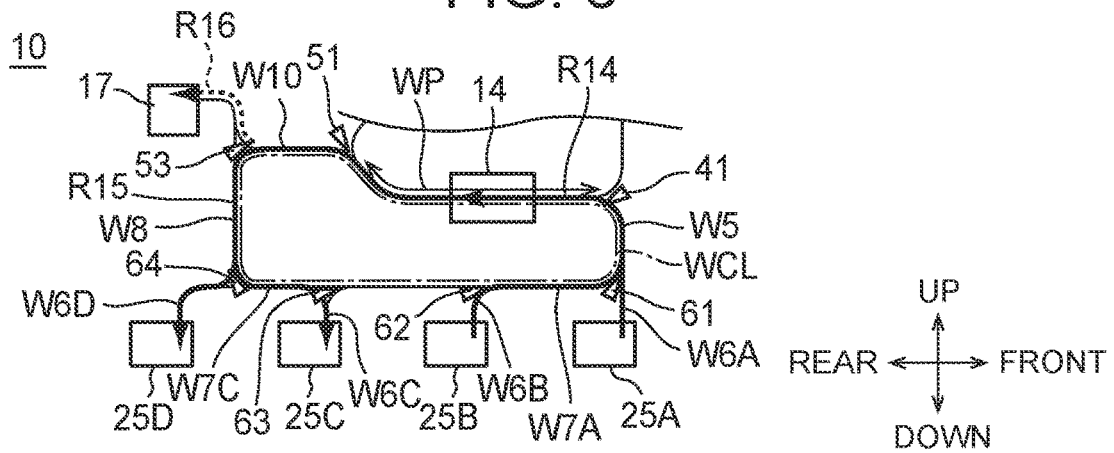
FIG. 8 is a schematic view illustrating a conveyance route of banknotes in a rearward banknote movement process.

Subsequently, as indicated by an arrow direction R14 in FIG. 8, the banknote deposit/withdrawal device 10 conveys banknotes along the conveyance path W6 (W6A or W6B), the conveyance path W7A, the conveyance path W5 and the basic conveyance path WP, thereby classifying the banknotes when passing through the classification section 14. Here, the banknote controller 11 identifies a traveling state based on the classification result, and thereby the banknote controller 11 determines the banknote storage boxes 25 as a conveyance destination of normal banknotes, while the banknote controller 11 determines the reject box 17 as a conveyance destination of rejected banknotes having a problem in a traveling state.

As indicated by an arrow direction R15, the banknote deposit/withdrawal device 10 conveys and stores the normal banknotes into the banknote storage box (25C or 25D) as the movement destination along the basic conveyance path WP, the conveyance path W10, the conveyance path W8, the conveyance path W7C, and the conveyance path W6 (W6C or W6D). Further, the banknote deposit/withdrawal device 10 conveys the rejected banknotes to the segregation switching unit 53 in the arrow direction R15, and then conveys the rejected banknotes along the conveyance path W9 as indicated by an arrow direction R16 to the reject box 17 and stores the rejected banknotes in the reject box 17.

3-4. Forward Banknote Movement Process

Next, in the banknote movement process in the banknote deposit/withdrawal device 10, a case will be described in which the banknotes are moved substantially frontward with the banknote storage box 25 (25C or 25D) located in the rear side as a movement source and the banknote storage box (25A or 25B) located in the front side as a movement destination. Hereinafter, this process is also referred to as a forward banknote movement process or a medium movement process.

More specifically, when the banknote deposit/withdrawal device 10 receives an instruction including, e.g., the banknote storage boxes 25 of the movement source and the movement destination and the number of banknotes to be moved from a financial institution staff via the operation display section 6 (FIG. 1), the banknote movement process is started. In the same manner as in the case of the withdrawal process (FIG. 7), the banknote deposit/withdrawal device 10 feeds out the banknotes stored therein while separating the banknotes one by one from the banknote storage box 25C or 25D designated as the movement source, and sequentially hands off the banknotes to the downstream conveyance path W6C or the conveyance path W6D.

Subsequently, as indicated by an arrow direction R17 in FIG. 9, the banknote deposit/withdrawal device 10 conveys banknotes along the conveyance path W6 (W6C or W6D), the conveyance path W7C, the conveyance path W8, the conveyance path W10 and the basic conveyance path WP, thereby classifying the banknotes when passing through the classification section 14. Here, the banknote controller 11 identifies a traveling state based on the classification result, and thereby the banknote controller 11 determines the banknote storage boxes 25 as a conveyance destination of normal banknotes, while the banknote controller 11 determines the reject box 17 as a conveyance destination of rejected banknotes having a problem in a traveling state.

As indicated by an arrow direction R18, the banknote deposit/withdrawal device 10 conveys the normal banknotes along the basic conveyance path WP, the conveyance path W5, the conveyance path W7A, and the conveyance path W6 (W6A or W6B) and stores the normal banknotes in the banknote storage box (25A or 25B) as the movement destination. For ease of explanation, a conveyance route of the banknotes indicated by the arrow direction R17 and the arrow direction R18 may also be referred to as a segregation classification conveyance route.

Here, when the rejected banknote is identified, the banknote deposit/withdrawal device 10 needs to convey and store the rejected banknote from the downstream side of the classification section 14 to the reject box 17. However, in the banknote deposit/withdrawal device 10, the conveyance route indicated by the arrow direction R17 overlaps with the segregation switching unit 53 that passes through when the banknotes are conveyed from the lower loop-shaped conveyance path WCL to the reject box 17. This mean that, if the rejected banknote is directly conveyed to the reject box 17, the rejected banknote collides with the other banknote fed out from the movement source and conveyed in the arrow direction R17, regardless of which conveyance route is selected. As a result, the rejected banknote and the other banknote may be damaged or jammed in the conveyance path.

Therefore, the banknote deposit/withdrawal device 10 evacuates the banknotes fed from the movement source from the conveyance route indicated by the arrow direction R17 and the arrow direction R18, and then conveys the rejected banknote to the reject box 17. After that, the movement of the banknotes from the movement source to the movement destination resumes.

3-5. Conveyance of the Rejected Banknote in the Forward Banknote Movement Process Next, a conveyance process of each banknote in the banknote deposit/withdrawal device 10 when a rejected banknote has been identified in the forward banknote movement process will be described with reference to a flowchart illustrated in FIG. 10. Herein, it is explained that the movement source is the banknote storage box 25D and the movement destination is the banknote storage box 25A.

Figure 10:
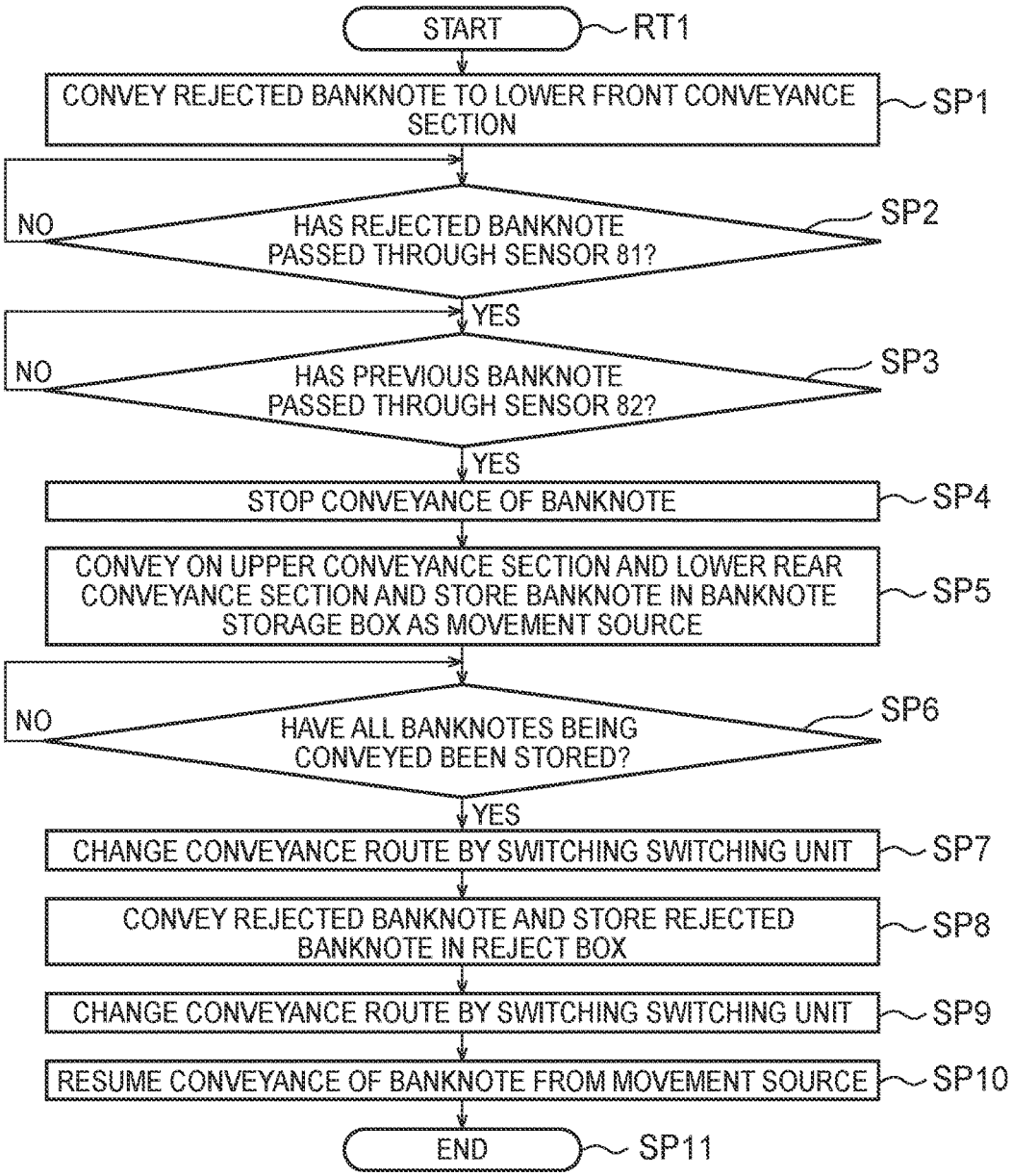
FIG. 10 is a flowchart illustrating a rejected banknote conveyance storage processing routine in a forward banknote movement process.

More specifically, when the banknote controller 11 of the banknote deposit/withdrawal device 10 determines that the banknote being conveyed is a rejected banknote based on the classification result obtained from the classification section 14 in the forward banknote movement process, the banknote controller 11 starts a rejected banknote conveyance storage processing routine RT1, illustrated in FIG. 10, and transitions to step SP1.

Figure 11:
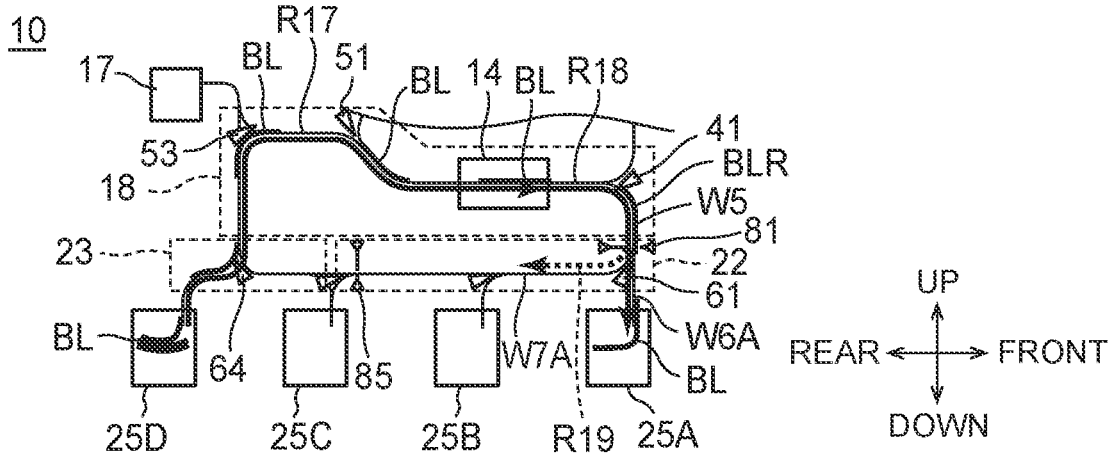
FIG. 11 is a schematic view illustrating a conveyance route of banknotes in the forward banknote movement process.

At this time, in the banknote deposit/withdrawal device 10, a rejected banknote BLR is located on the downstream side of the classification section 14 in the conveyance route indicated by the arrow direction R18, as illustrated in FIG. 11. Further, in the banknote deposit/withdrawal device 10, a plurality of banknotes BL fed out from the banknote storage box 25D as the movement source after the rejected banknote BLR are discretely conveyed on the conveyance route indicated by the arrow direction R17.

Figure 12:
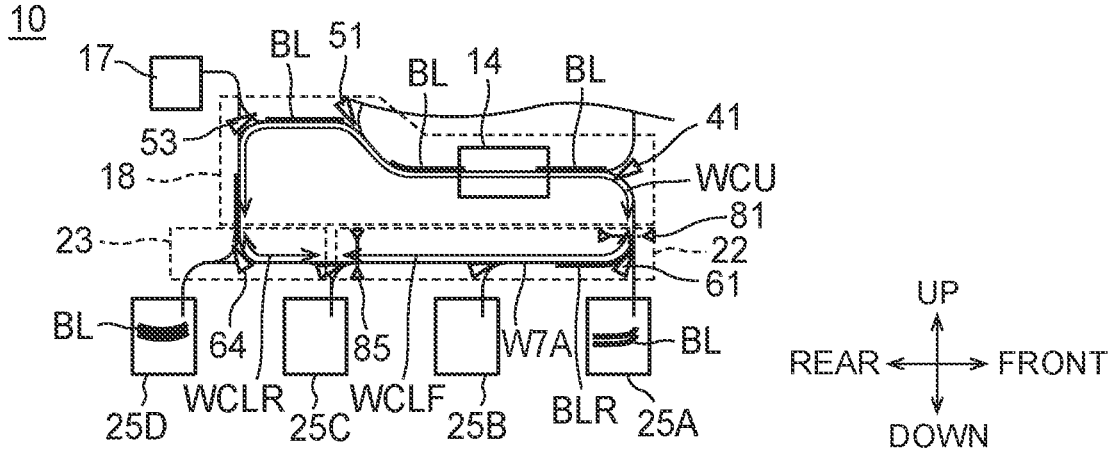
FIG. 12 is a schematic view illustrating a conveyance route of banknotes in the forward banknote movement process.

At step SP1, the banknote controller 11 advances the rejected banknote BLR into the lower front conveyance section 22 in an arrow direction R19, and transitions to next step SP2. At this time, the banknote controller 11 confirms that the banknote BL conveyed before the rejected banknote BLR has passed through the sensor 81, and controls the switching unit 61, thereby changing from a conveyance route connecting the conveyance path W5 and the conveyance path W6A to a conveyance route connecting the conveyance oath W5 and the conveyance path W7A. Thereby, the banknote controller 11 advances the rejected banknote BLR to the conveyance path W7A, as illustrated in FIG. 12.

At step SP2, the banknote controller 11 determines whether or not the rejected banknote BLR has been passed through the sensor 81. When the result is negative, the banknote controller 11 waits for the rejected banknote BLR to pass through the sensor 81 by repeating the processing at the step SP2.

On the other hand, when the result is affirmative at the step SP2, the banknote controller 11 transitions to the next step SP3, and determines whether or not the banknote BL conveyed before the rejected banknote BLR has been passed through the sensor 82. When the result is negative, the banknote controller 11 waits for the banknote BL to pass through the sensor 82 by repeating the processing at the step SP3.

When the result is affirmative at the step SP3, the entire rejected banknote BLR is on the lower front loop-shaped conveyance path WCLF in the lower front conveyance section 22 and all banknotes conveyed before the rejected banknote BLR have been stored in the banknote storage box 25A. In such cases, the banknote controller 11 transitions to the next step SP4, and stops all driving of the rollers and the like in the upper conveyance section 18, the lower front conveyance section 22 and the lower rear conveyance section 23 before a tip of the rejected banknote BLR reaches the sensor 85. Thereby, the banknote controller 11 transitions to the next step SP5.

Thereby, as illustrated in FIG. 12, the banknote controller 11 can stop the rejected banknote BLR on the lower front loop-shaped conveyance path WCLF in the lower front conveyance section 22. In addition, the banknote controller 11 stops the banknotes BL fed out from the movement source following the rejected banknote BLR on the conveyance path indicated by the arrow direction R17 and the arrow direction R18 (FIG. 11), that is, on a part of the upper loop-shaped conveyance path WCU in the upper conveyance path 18 and the lower rear loop-shaped conveyance path WCLR in the lower rear conveyance section 13.

At step SP5, the banknote controller 11 rotates the conveyance rollers or the like in the upper conveyance section 18 and the lower rear conveyance section 23 in a reverse direction while stopping the lower front loop-shaped conveyance path WCLF in the lower front conveyance section 22, and transitions to the next step SP6. Thereby, the banknote deposit/withdrawal device 10 sequentially conveys the banknotes BL stopped on the upper loop-shaped conveyance path WCU in the upper conveyance section 18 and the lower rear loop-shaped conveyance path WCLR in the lower rear conveyance section 23 (FIG. 12) in an arrow direction R21 illustrated in FIG. 13, that is, in an opposite direction of the arrow direction R17 and the arrow direction R18 (FIG. 11), and then stores them in the banknote storage box 25D as the movement source.

At step SP6, the banknote controller 11 determines whether or not all banknotes BL on the conveyance path indicated by the arrow direction R21 store in the banknote storage box 25D as the movement source. More specifically, the banknote controller 11 determines whether or not the time elapsed after the conveyance roller and the like in the upper conveyance section 18 and the lower rear conveyance section 23 are started to rotate in the reverse direction exceeds a predetermined reverse conveyance time. When the result is negative, the banknote controller 11 waits for the reverse conveyance time to elapse by repeating the processing at the step SP6.

On the other hand, when the result is affirmative at the step SP6, all banknotes BL on the conveyance path in the upper conveyance section 18 and the lower rear conveyance section 23 indicated by the arrow direction R21 have been stored in the banknote storage box 25D as the movement source. Moreover, this also means that all the other banknotes BL have been evacuated from the conveyance path for conveying the rejected banknote BLR from the lower front conveyance section 22 to the reject box 17. In such cases, the banknote controller 11 transitions to the next step SP7.

At step SP7, the banknote controller 11 controls the segregation switching unit 53 to change the current conveyance route from a conveyance route (FIG. 13) connecting the conveyance path W8 and the conveyance path W10 to a conveyance route (FIG. 14) connecting the conveyance path W9 and the conveyance path W10, and then transitions to the next step SP8. As a result, the banknote controller 11 advances the banknotes BL that have been conveyed rearward along the conveyance path W10 to the conveyance path W9, that is, to the reject box 17.

Figure 15:
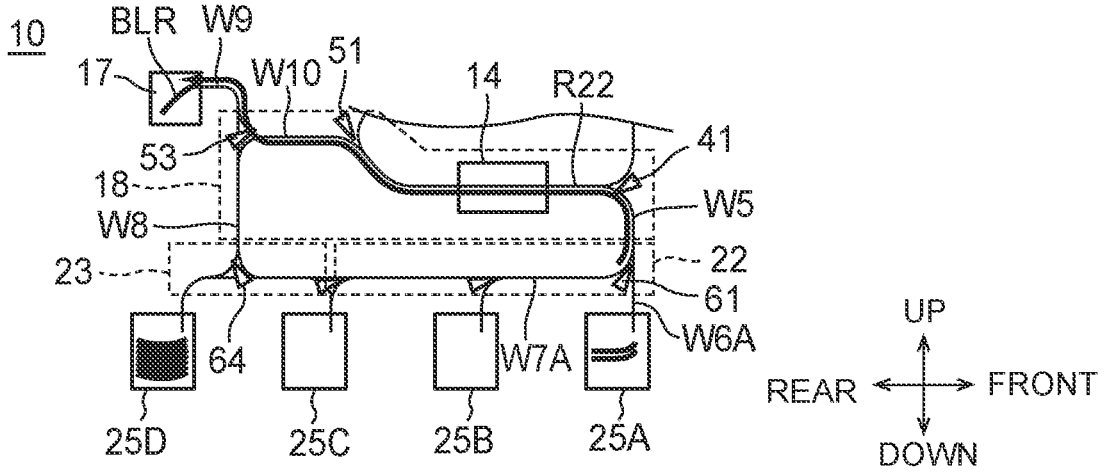
FIG. 15 is a schematic view illustrating a conveyance route of banknotes in the forward banknote movement process.

At step SP8, as illustrated in FIG. 15, the banknote controller 11 conveys and stores the rejected banknote BLR to the reject box 17 along the conveyance path indicated by an arrow direction R22. Specifically, the banknote controller 11 conveys the rejected banknote BLR while partially reverse driving the conveyance path from the banknote storage box 25D to the banknote storage box 25, and stores the rejected banknote BLR in the reject box 25. The banknote controller 11 transitions to the next step SP9. In such cases, the reject box 17 detects that the rejected banknote BLR has been stored by a predetermined sensor (not illustrated) provided inside thereof, and sends out it to the banknote controller 11.

At step SP9, the banknote controller 11 controls the segregation switching unit 53 to change the current conveyance route from the conveyance route (FIG. 14) connecting the conveyance path W9 and the conveyance path W10 to the conveyance route (FIG. 13) connecting the conveyance path W8 and the conveyance path W10, thereby returning the conveyance path. Thereby, the banknote controller 11 can advance the banknotes BL that have been fed our from the banknote storage box 25D as the movement source and that have been conveyed upward along the conveyance path W8 to the conveyance path W10, that is, to the classification section 14 and the banknote storage box 25A. Moreover, the banknote controller 11 controls the switching unit 61 to return from a conveyance route connecting the conveyance path W5 and the conveyance path W7A to a conveyance route connecting the conveyance path W5 and the conveyance path W6A, and then transitions to the next step SP10.

At step SP10, the banknote controller 11 resumes the conveyance of the banknotes from the banknote storage box 25D as the movement source to the banknote storage box 25A, and then transitions to the next step SP11, and ends the rejected banknote conveyance storage processing routine RT1. Thereby, the banknote deposit/withdrawal device 10 can sequentially convey the banknote along the conveyance route indicated by the arrow direction R17 and the arrow direction R18 (FIG. 9).

4. Effects

Figure 7:
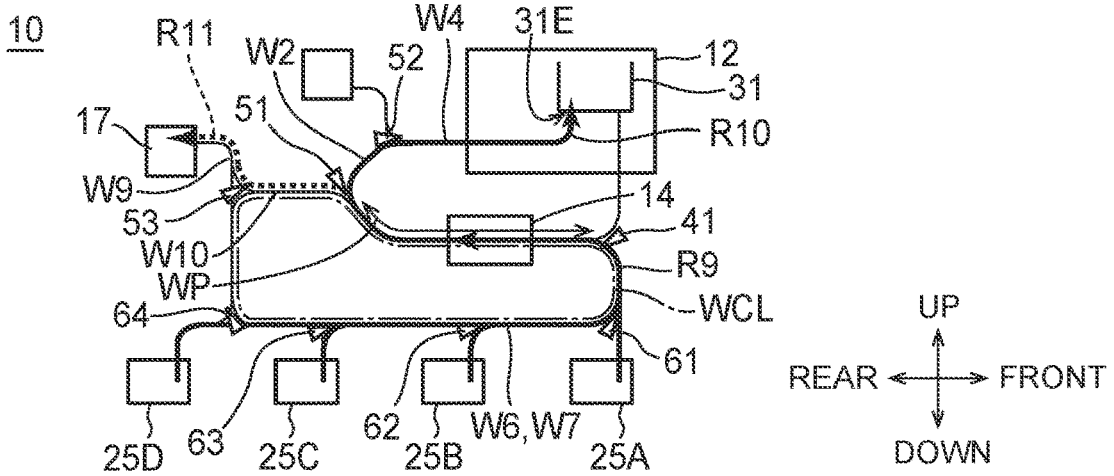
FIG. 7 is a schematic view illustrating a conveyance route of banknotes in a withdrawal process.

In the above-described configuration, the banknote deposit/withdrawal device 10 of the present exemplary embodiment executes the rearward banknote movement process (FIG. 8) and the he forward banknote movement process (FIG. 9), in addition to the deposit process (FIG. 6A and FIG. 6B) and the withdrawal process (FIG. 7). In particular, since the banknote deposit/withdrawal device 10 forms the loop-shaped conveyance path WCL (FIG. 5), the banknote deposit/withdrawal device 10 does not need to move the banknote in multiple times while using a temporary holding section and the like as disclosed in Japanese Patent Application Laid-Open (JP-A) No. 2013-25438, and can directly and continuously convey the banknote from the movement source to the movement destination via a part of the loop-shaped conveyance path WCL. Generally, in the banknote deposit/withdrawal device 10, the reject rate of the banknotes fed out from the banknote storage boxes 25 is extremely low. Even when considering the time required to convey the rejected banknotes, the banknote deposit/withdrawal device 10 can efficiently complete each movement process in about half the time or less required to move the banknotes in multiple times while using the temporary holding section and the like.

Figure 13:
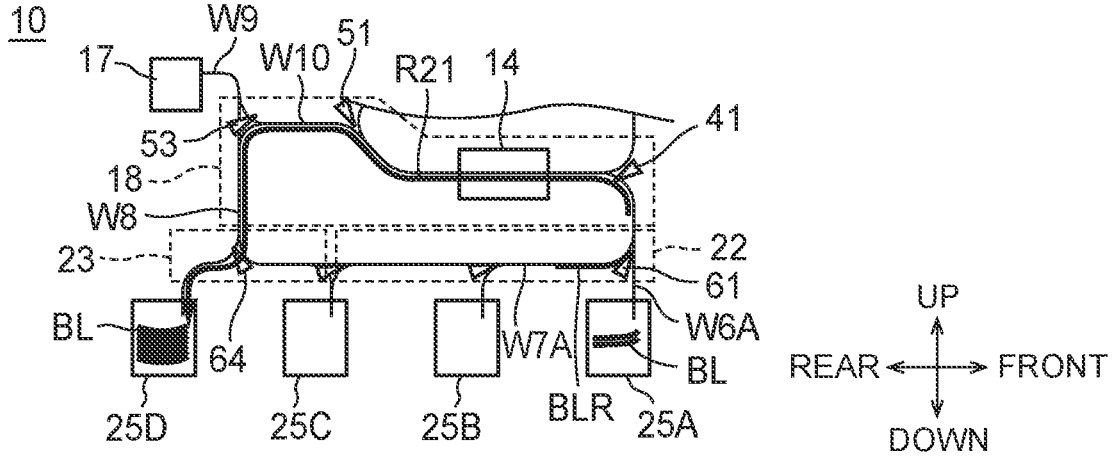
FIG. 13 is a schematic view illustrating a conveyance route of banknotes in the forward banknote movement process.

In the case where he classification section 14 identifies as the rejected banknote BLR in the frontward banknote movement process, the banknote deposit/withdrawal device 10 first conveys the rejected banknote BLR and then stops the rejected banknotes BLR on the lower front loop-shaped conveyance path WCLF in the lower front conveyance section 22 (FIG. 12). Then, the banknote deposit/withdrawal device 10 keeps the rejected banknote BLR stopped in the lower front conveyance section 22, and conveys each banknote BL on the upper loop-shaped conveyance path WCU in the upper conveyance section 18 and the lower rear loop-shaped conveyance path WCLR in the lower rear conveyance section 23 backward, thereby storing each banknote BL in the banknote storage box 25D as the movement source (FIG. 13).

Next, the banknote deposit/withdrawal device 10 changes the current conveyance route to the conveyance route connecting the conveyance path W9 and the conveyance path W10 by switching the segregation switching unit 53 (FIG. 14), and then conveys the rejected banknote BLR on the lower front conveyance section 22 in the arrow direction R22, thereby storing the rejected banknote BLR in the reject box 17 (FIG. 15). After that, the banknote deposit/withdrawal device 10 returns to the conveyance route connecting the conveyance path W8 and the conveyance path W10 by switching the segregation switching unit 53, and then conveys the banknotes stored in the banknote storage box 25D as the movement source again to the banknote storage box 25A as the movement destination along the conveyance route indicated by the arrow direction R17 and the arrow direction R18 (FIG. 9).

Thereby, the banknote deposit/withdrawal device 10 can convey and store the rejected banknote BLR identified in the forward banknote movement process in the reject box 17 without colliding with other banknotes BL, and can convey and stores the normal banknotes BL in the banknote storage box 25A as the movement destination after the normal banknotes BL are evacuated to the banknote storage box 25D as the movement source.

In forward banknote movement process in the banknote deposit/withdrawal device 10, the banknotes fed out from the banknote storage box 25D as the movement source are conveyed by a part of the lower conveyance section 21 and are handed off to the upper rear conveyance section 15. Further, the banknotes handed off from the upper front conveyance section 13 are conveyed to the banknote storage box 25A as the movement destination by a part of the lower conveyance section 21. Specifically, in the forward banknote movement process in the banknote deposit/withdrawal device 10, the banknote immediately after being fed out from the movement source and the banknote immediately before being stored to the movement destination are both conveyed by the lower conveyance section 21.

If the drive of the lower conveyance section 21 is not to be divided and the drive of the entire lower conveyance section 21 is collectively controlled, the entire lower conveyance section 21 is stopped when the rejected banknote BLR conveyed near the conveyance path W7A (FIG. 5) is stopped. Therefore, the other banknotes cannot be conveyed to the banknote storage box 25D as the movement source.

The banknote deposit/withdrawal device 10 according to the present exemplary embodiment divided the lower conveyance section 21 into the lower front conveyance section 22 and the lower rear conveyance section 23, and is configured so that the lower front conveyance section 22 is controlled by the lower front drive motor M2 and the lower rear conveyance section 23 is controlled by the lower rear drive motor M3 individually. Thereby, the banknote deposit/withdrawal device 10 can drive the conveyance path in the lower rear conveyance section 23 and can convey the other banknotes BL while keeping the rejected banknote BLR stopped on the conveyance path in the lower front conveyance section 22.

Specifically, since the conveyance path in the lower front conveyance section 22, which is a part of the lower loop-shaped conveyance path WCL (FIG. 5), can be used as a temporary storage space for the rejected banknote BLR, the banknote deposit/withdrawal device 10 does not need to separately provide a storage box or the like storing the rejected banknote BLR.

From another perspective, in the forward banknote movement process in the banknote deposit/withdrawal device 10, the reject box 17 is provided on the upstream of the classification section 14 with respect to the conveyance route from the banknote storage box 25D as the movement source to the banknote storage box 25A as the movement destination through the classification section 14 (hereinafter, referred to as a forward movement route) along the arrow direction R17 and the arrow direction R18.

In the banknote deposit/withdrawal device 10, when identifying the rejected banknote BLR, each banknote is conveyed backward by the upper conveyance section 18 and the lower rear conveyance section 23, which are upstream of the rejected banknote BLR in the forward movement path while stopping the rejected banknote BLR on the conveyance path in the lower front conveyance section 22, which is the downstream of the classification section 14. Thereby, the banknote deposit/withdrawal device 10 can reliably evacuate the other banknotes BL from a route portion of the forward movement route for causing the rejected banknote BLR to reach the reject box 17, that is, an overlapping portion of a conveyance route indicated by the arrow direction R17 (FIG. 9) and the arrow direction R18 and a conveyance route indicated by the arrow direction R22 (FIG. 14).

The banknote controller 11 switches the segregation switching unit 53 after all banknotes BL on the forward movement route are returned to the banknote storage box 25D as the movement source (FIG. 10 and the step SP4 and the step SP5). Thereby, the banknote deposit/withdrawal device 10 can change the conveyance route by switching the segregation switching unit 53 in a state where there is no banknote around the segregation switching unit 53, and can reliably prevent the banknotes BL from being caught and damaged when rotating the blade.

Figure 14:
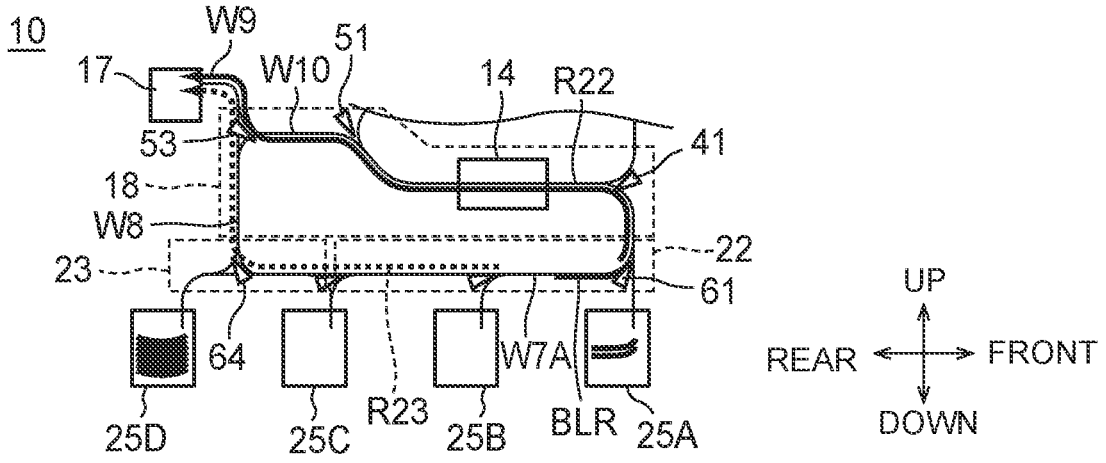
FIG. 14 is a schematic view illustrating a conveyance route of banknotes in the forward banknote movement process.

The banknote controller 11 conveys the rejected banknote BLR to the reject box 17 along a route indicated by the arrow direction R22, which is not a route indicated by the arrow direction R23 (FIG. 14). Thereby, even if a part of banknotes BL remains on the conveyance path when other banknotes BL are returned to the banknote storage boxes 25D as the movement source, the banknote deposit/withdrawal device 10 can convey the banknotes BL remaining together with the rejected banknote BLR to the reject box 17 and then can store them in the reject box 17. In other words, the forward movement route can be cleaned. As a result, in the banknote deposit/withdrawal device 10, each banknote BL can be smoothly conveyed after resuming the forward banknote movement process.

Referring to the storage process (FIG. 6B) and the withdrawal process (FIG. 7), the banknote deposit/withdrawal device 10 may integrally drive the lower loop-shaped conveyance path WCL (FIG. 5) in the lower conveyance section 21. Specifically, the banknote deposit/withdrawal device 10 does not need to drive by dividing the lower conveyance section 21. In other words, in terms of realizing basic processing such as the storage process and the withdrawal process, the banknote deposit/withdrawal device 10 may be controlled such that the entire lower conveyance section 21 is driven by one drive motor without dividing the lower conveyance section 21.

In the banknote deposit/withdrawal device 10 according to the present exemplary embodiment, the lower conveyance section 21 is divided into the lower front conveyance section 22 and the lower rear conveyance section 23, and drive motors are provided in the each of the lower front conveyance section 22 and the lower rear conveyance section 23. Thereby, the banknote deposit/withdrawal device 10 can convey the rejected banknote identified in the forward banknote movement process to the reject box 17 without colliding with other banknotes and then can store them in the reject box 17.

Specifically, as compared with the case where the entire lower conveyance section 21 is integrally controlled without dividing the lower conveyance section 21, the banknote deposit/withdrawal device 10 has one additional drive motor and the transmission route of driving force is divided into the front side and the rear side. Thereby, the banknote deposit/withdrawal device 10 can realize an appropriate conveyance process of the rejected banknote in the forward banknote movement process while suppressing the change of the configuration and the increase in the number of components to the necessary minimum.

According to the above configuration, in the banknote deposit/withdrawal device 10 of the ATM 1, the lower conveyance section 21 is divided into the lower front conveyance section 22 and the lower rear conveyance section 23. When identifying the rejected banknote BLR in the forward banknote movement process, the banknote controller 11 of the banknote deposit/withdrawal device 10 conveys the banknotes BL on the upper conveyance section 18 and the lower rear conveyance section 23 backward while keeping the rejected banknote BLR on the conveyance path in the lower front conveyance section 22, and then stores the banknotes BL in the banknote storage box 25D as the movement source. Thereby, the banknote deposit/withdrawal device 10 can convey the rejected banknote BLR to the reject box 17 connected to the upstream of the classification section 14 and can store the rejected banknote BLR in a state where the other banknotes BL are evacuated from the conveyance route.

5. Other Exemplary Embodiments

In the above-described exemplary embodiment, the case has been described in which the lower conveyance section 21 is divided into the lower front conveyance section 22 and the lower rear conveyance section 23 by dividing into two conveyance sections. However, the present disclosure is not limited to this. The lower conveyance section 21 may be divided into three or more conveyance sections. Specifically, in the forward banknote movement process in the banknote deposit/withdrawal device 10 in which the reject box 17 is provided on the upstream of the classification section 14, it should be possible to control so that a part of the lower conveyance section 21 that conveys the banknotes fed out from the banknote storage box 25D, which is the movement source, and a part of the lower conveyance section 21 that keeps the rejected banknote BLR and conveys the banknotes stored in the banknote storage box 25A, which is the movement destination are driven separately.

In the above-described exemplary embodiment, the case has been described in which the rejected banknote BLR is kept on the conveyance path W7A in the lower front conveyance path 22 (FIG. 5), that is, on the conveyance path 73 (FIG. 4). However, the present disclosure is not limited to this. For example, in a case where the conveyance path 71, the conveyance path 72, or the total of the conveyance path 71 and the conveyance path 72 has a sufficient length, the rejected banknote BLR may be kept on the conveyance path 71 or the conveyance path 72, or a location straddling the conveyance path 71 and the conveyance path 72.

Figure 9:
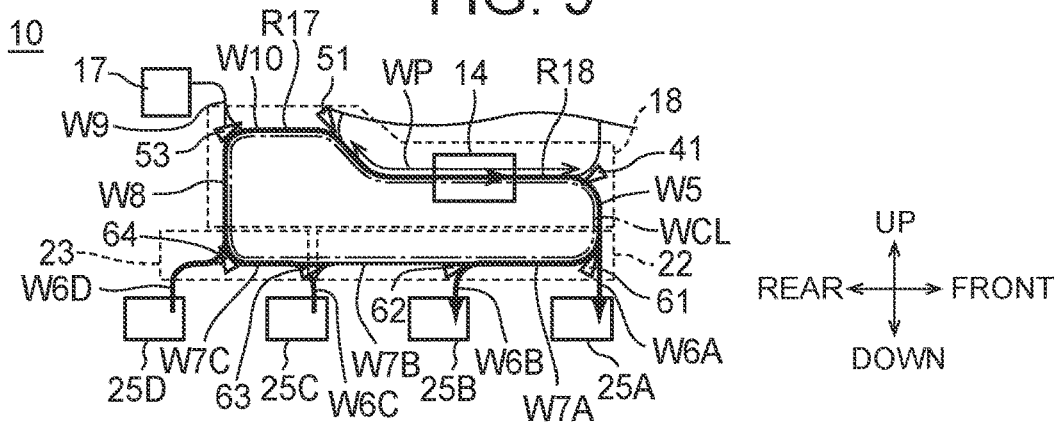
FIG. 9 is a schematic view illustrating a conveyance route of banknotes in a forward banknote movement process.

In the above-described exemplary embodiment, the case has been described in which the movement source is the banknote storage box 25D, and the movement destination is the banknote storage box 25A as the forward banknote movement process (FIG. 9). However, the present disclosure is not limited to this. For example, the movement source may be the banknote storage box 25C, and the movement destination may be the banknote storage box 25B.

In the above-described exemplary embodiment, the case has been described in which the movement sources is the banknote storage box 25D or the banknote storage box 25C, and the movement destination is the banknote storage box 25A or the banknote storage box 25B as the forward banknote movement process. However, the present disclosure is not limited to this. For example, in the forward banknote movement process, the movement source may be only the banknote storage box 25, and the movement destination may be any of the banknote storage box 25A, the banknote storage box 25B, or the banknote storage box 25C. In this case, a pair of rollers and the like in the lower conveyance section 21 located directly above the banknote storage box 25D may be the lower rear conveyance section 23, and a pair of rollers and the like located above the banknote storage box 25A, the banknote storage box 25B and the banknote storage box 25C may be the lower front conveyance section 22.

In the above-described exemplary embodiment, the case has been described in which the banknote controller 11 determines that the entire rejected banknote BLR has reached the lower front conveyance section 22 based on the detection result of the sensor 81 and the sensor 85 (FIG. 4 and FIG. 11). However, the present disclosure is not limited to this. For example, the banknote controller 11 may determine that the entire rejected banknote BLR is in the lower front conveyance section 22 by various methods such as the number of rotations of the conveyance roller after the tip of the rejected banknote BLR has passed the sensor 81, or the conveyance speed and the elapsed time after the rejected banknote BLR has passed the classification section 14.

In the above-described exemplary embodiment, the case has been described in which, when returning the banknotes BL other than the rejected banknote BLR remaining on the conveyance route indicated by the arrow R17 and the arrow direction 18 (FIG. 11 and FIG. 12) to the banknote storage box 25D (FIG. 10 and the step SP4), the banknote controller 11 may determine whether or not all banknotes BL have been conveyed based on the elapsed time. However, the present disclosure is not limited to this. For example, the banknote controller 11 may determine whether or not all banknotes BL have been conveyed based on the number of banknotes BL passed through the sensor 88 and the sensor 89 (FIG. 4).

In the above-described exemplary embodiment, the case has been described in which the banknotes BL other than the rejected banknote BLR remaining on the conveyance route indicated by the arrow R17 and the arrow direction 18 (FIG. 11 and FIG. 12) are returned to the banknote storage box 25D, which is the movement source. However, the present disclosure is not limited to this. For example, the banknotes BL may be conveyed to the temporary holding section 16, the customer interface section 12, or the like.

In the above-described exemplary embodiment, the case has been described in which the rejected banknote BLR is conveyed by the conveyance route indicated by the arrow direction R22 (FIG. 14), that is, a route that a part of the forward movement route proceeds in the reverse direction. However, the present disclosure is not limited to this. For example, the rejected banknote BLR may be conveyed by the conveyance route indicated by the arrow direction R23, that is, a route that a part of the forward movement route proceeds in the forward direction.

In the above-described exemplary embodiment, the case has been described in which, when the rejected banknote BLR is conveyed in the arrow direction R22 (FIG. 22) and is passed through the classification section 14, the rejected banknote BLR is stored in the reject box 17 without using the classification result in the classification section 14. However, the present disclosure is not limited to this. For example, the banknote controller 11 may re-classify based on the classification result when the rejected banknote BLR is conveyed in the arrow direction R22 (FIG. 14) and is passed through the classification section 14. In addition, when the rejected banknote BLR is determined as a normal banknote, the banknote controller 11 may store the rejected banknote BLR determined as the normal banknote in the banknote storage box 25A, which is the movement destination.

In the above-described exemplary embodiment, the case has been described in which the four banknote storage boxes 25 are connected to the lower conveyance section 14.

However, the present disclosure is not limited to this. Three or less or five or more banknote storage boxes 25 may be connected to the lower conveyance section 21. Further, the reject box 17 may be connected to the lower conveyance section 21.

In the above-described exemplary embodiment, the case has been described in which one upper drive motor M1 is provided in the upper conveyance section 18. However, the present disclosure is not limited to this. For example, each roller and the like in the upper conveyance section 18 may be driven by two or more drive motors. Specifically, it is sufficient that the roller and the like in the upper conveyance section 18 can be driven independently of the roller and the like in the lower front conveyance section 22 and the roller and the like in the lower rear conveyance section 23.

In the above-described exemplary embodiment, the case has been described in which the driving force of the upper drive motor M1 is supplied to each roller and the like in the upper conveyance section 18, the driving force of the lower front drive motor M2 is supplied to each roller and the like in the lower front conveyance section 22, and the driving force of the lower rear drive motor M3 is supplied to each roller and the like in the lower rear conveyance section 23. However, the present disclosure is not limited to this. For example, the driving force of the upper drive motor M1 may be supplied to each roller and the like in the lower rear conveyance section 23 in addition to each roller and the like in the upper conveyance section 18. Specifically, it is sufficient that each roller and the like in the lower front conveyance section 22 and each roller and the like in the lower rear conveyance section 23 can be driven and controlled independently each other.

In the above-described exemplary embodiment, the case has been described in which the present disclosure is applied to the banknote deposit/withdrawal device 10 that handles the banknote as the medium. However, the present disclosure is not limited to this. For example, the present disclosure may be applied to various devices that handle various sheet-shape media such as stock certificates, securities, cash vouchers, gift certificates, or the like.

The present disclosure is not limited to the exemplary embodiment and the other exemplary embodiments described above. Namely, the range of application of the present disclosure encompasses exemplary embodiments appropriately combining elements of some or all of the exemplary embodiment and the other exemplary embodiments described above, and embodiments deriving from elements thereof.

In the above-described exemplary embodiment, the case has been described in which the banknote deposit/withdrawal device 10 as the medium processing device is configured by the loop-shaped conveyance path WC as the loop-shaped conveyance path (i.e., the first, second and third conveyance paths), the classification section 14 as the classification section, the storage switching unit (63 or 64) as the storage switching unit (i.e., a first switching unit), the switching unit (61 or 62) as the storage switching unit (i.e., a second switching unit), the banknote storage box 25 (25C or 25D) as the storage box (i.e., a first storage box), the banknote storage box 25 (25A or 25B) as the storage box (i.e., a second storage box), the segregation switching unit 53 as the segregation switching unit (i.e., a third switching unit), the reject box as the segregation storage box (i.e., the third storage box), and the banknote controller 11 as the controller. However, the present disclosure is not limited to this. The medium processing device may be configured by a loop-shaped conveyance path, a classification section, a storage switching unit, a storage box, a segregation switching unit, a segregation storage box, and a controller of various other configurations.

INDUSTRIAL APPLICABILITY

The present disclosure may be employed in, for example, a banknote deposit/withdrawal device incorporated in an automatic teller machine that performs a deposit transaction or a withdrawal transaction regarding banknotes with a user.

The disclosure of Japanese Patent Application No. 2018-098577 filed on May 23, 2018, the entire contents which are incorporated herein by reference.

The invention claimed is:

1. A medium processing device, comprising:

a first conveyance path, a second conveyance path and a third conveyance path for conveying media;

a classification section that is provided on the third conveyance path, and that classifies the media passing thereby;

a first switching unit that is provided on the first conveyance path;

a second switching unit that is provided on the second conveyance path;

a third switching unit that is provided on the third conveyance path at a first side of the classification section;

a first storage box that is connected to the first switching unit, and that stores the media conveyed by the first conveyance path;

a second storage box that is connected to the second switching unit, and that stores the media conveyed by the second conveyance path;

a third storage box that is connected to the third switching unit, and that stores a segregation medium among the media; and a controller that controls the first, second and third conveyance paths, and controls the first, second and third switching units for changing a conveyance route of the media; wherein each of the first, second and third conveyance paths has two ends, one end of the first conveyance path is connected to one end of the third conveyance path at the first side of the classification section, one end of the second conveyance path is connected to the other end of the third conveyance path at a second side of the classification section opposite to the first side, the other end of the first conveyance path is connected to the other end of the second conveyance path, and the controller controls the first conveyance path and the second conveyance path so that the first and second conveyance paths are driven independently from each other.

2. The medium processing device of claim 1, wherein the controller controls the first, second and third conveyance paths, so that the first, second and third conveyance paths are driven independently from one another.

3. The medium processing device of claim 1, wherein the medium processing device is configured to perform a medium movement process of sequentially conveying ones of the media from the first storage box to the first conveyance path, the third conveyance path, the second conveyance path, and the second storage box in order, the classification section is configured to classify said ones of the media, and to identify the segregation medium based on a classification result thereof in the medium movement process, and upon identifying the segregation medium, the controller causes the segregation medium to remain on the second conveyance path, and to be stored to the third storage box, after other media other than the segregation medium conveyed on first conveyance path and the third conveyance path have been conveyed out of the first conveyance path and the third conveyance path.

4. The medium processing device of claim 3, wherein the controller causes the other media conveyed on the first conveyance path and the third conveyance path to be conveyed backward and to be stored in the second storage box.

5. The medium processing device of claim 3, wherein after the other media conveyed on the first conveyance path and the third conveyance path are conveyed to outside the first conveyance path and the third conveyance path, the controller changes the conveyance route of the media by switching the third switching unit, and stores the segregation medium in the third storage box while causing the second conveyance path and the third conveyance path to convey backward.

6. The medium processing device of claim 3, further comprising a medium detection sensor that is provided in a vicinity of a location where the second conveyance path is connected to the third conveyance path, and that detects the media passing thereby, wherein the controller determines whether or not the segregation medium has reached the second conveyance path by the medium detection sensor.

7. An automatic transaction device, comprising:

a deposit port that receives media to be transacted;

a first conveyance path, a second conveyance path and a third conveyance path for conveying the media;

a classification section that is provided on the third conveyance path, and that classifies the media passing thereby;

a first switching unit that is provided on the first conveyance path;

a second switching unit that is provided on the second conveyance path;

a third switching unit that is provided on the third conveyance path at a first side of the classification section;

a first storage box that is connected to the first switching unit, and stores the media conveyed by the first conveyance path;

a second storage box that is connected to the second switching unit, and stores the media conveyed by the second conveyance path;

a third storage box that is connected to the third switching unit, and that stores a segregation medium among the media; and a controller that controls the first, second and third conveyance paths, and controls the first, second and third switching units for changing a conveyance route of the media; wherein each of the first, second and third conveyance paths has two ends, one end of the first conveyance path is connected to one end of the third conveyance path at the first side of the classification section, one end of the second conveyance path is connected to the other end of the third conveyance path at a second side of the classification section opposite to the first side, the other end of the first conveyance path is connected to the other end of the second conveyance path, and the controller controls the first conveyance path and the second conveyance path so that the first and second conveyance paths are driven independently from each other.

* * * * *